United States Patent [19]

Sawada et al.

[11] Patent Number: 4,964,271

[45] Date of Patent: Oct. 23, 1990

[54] AIR-FUEL RATIO FEEDBACK CONTROL SYSTEM INCLUDING AT LEAST DOWNSTREAM-SIDE AIR-FUEL RATIO SENSOR

[75] Inventors: Hiroshi Sawada, Gotenba; Tatehito Ueda, Susono; Kiyoshi Nakanishi, Susono; Takayuki Demura, Mishima, all of Japan

[73] Assignee: Toyota Jidosha Kabushiki Kaisha, Aichi, Japan

[21] Appl. No.: 163,871

[22] Filed: Mar. 3, 1988

[30] Foreign Application Priority Data

Mar. 6, 1987 [JP] Japan ..... 62-50325
Mar. 6, 1987 [JP] Japan ..... 62-50326

[51] Int. Cl.[5] ..... F02D 41/14

[52] U.S. Cl. ..... 60/274; 60/276; 60/285; 123/325; 123/489

[58] Field of Search ..... 123/440, 489, 589, 325; 60/274, 276, 285

[56] References Cited

U.S. PATENT DOCUMENTS

| | | | |
|---|---|---|---|
| 3,939,654 | 2/1976 | Creps | 60/276 |
| 4,027,477 | 6/1977 | Storey | 60/276 |
| 4,089,313 | 5/1978 | Asano et al. | 123/440 |
| 4,130,095 | 12/1978 | Bowler et al. | 123/440 |
| 4,186,691 | 2/1980 | Takase et al. | 60/276 |
| 4,235,204 | 11/1980 | Rice | 123/440 |
| 4,475,517 | 10/1984 | Kobayashi et al. | 123/489 |
| 4,539,958 | 9/1985 | Ito et al. | 123/440 |
| 4,561,400 | 12/1985 | Hattori | 123/478 |
| 4,571,683 | 2/1986 | Kobayashi et al. | 364/431.05 |
| 4,697,567 | 10/1987 | Sawada et al. | 123/489 |
| 4,712,373 | 12/1987 | Nagai et al. | 60/285 |

FOREIGN PATENT DOCUMENTS

| | | | |
|---|---|---|---|
| 52-102934 | 8/1977 | Japan . | |
| 53-103796 | 9/1978 | Japan . | |
| 55-37562 | 3/1980 | Japan . | |
| 57-32772 | 7/1982 | Japan . | |
| 57-32773 | 7/1982 | Japan . | |
| 57-32774 | 7/1982 | Japan . | |
| 57-135243 | 8/1982 | Japan | 123/440 |
| 58-27848 | 2/1983 | Japan . | |
| 58-48755 | 3/1983 | Japan . | |
| 58-48756 | 3/1983 | Japan . | |
| 58-53661 | 3/1983 | Japan . | |
| 58-72646 | 4/1983 | Japan . | |
| 58-72647 | 4/1983 | Japan . | |
| 58-135343 | 8/1983 | Japan . | |
| 58-150038 | 9/1983 | Japan . | |
| 58-150039 | 9/1983 | Japan . | |
| 58-152147 | 9/1983 | Japan . | |
| 59-32644 | 2/1984 | Japan . | |
| 59-206638 | 11/1984 | Japan . | |
| 60-1340 | 1/1985 | Japan . | |
| 60-26138 | 2/1985 | Japan . | |
| 60-53635 | 3/1985 | Japan . | |
| 61-34330 | 2/1986 | Japan . | |
| 61-53436 | 3/1986 | Japan . | |

*Primary Examiner*—Andrew M. Dolinar
*Attorney, Agent, or Firm*—Oliff & Berridge

[57] ABSTRACT

In an air-fuel ratio feedback control system including at least one air-fuel ratio sensor downstream of a catalyst converter provided in an exhaust gas passage, an actual air-fuel ratio is controlled in accordance with the output of the downstream-side air-fuel ratio sensor. When at least one of the air-fuel ratio feedback control conditions for the downstream-side air-fuel ratio sensor is not satisfied the controlled air-fuel ratio is made an air-fuel ratio by an open loop control, while all the air-fuel ratio feedback control conditions for the downstream-side air-fuel ration sensor are satisfied the controlled air-fuel ratio is made the stoichiometric ratio ($\lambda=1$) in accordance with the output of the downstream-side air-fuel ratio sensor. For a period after all the air-fuel ratio feedback control conditions for the downstream-side air-fuel ratio sensor are satisfied, the control by the output of the downstream-side air-fuel ratio sensor is prohibited, but, the controlled air-fuel ratio is made the stoichiometric ratio ($\lambda=1$) by an open loop control or by the output of an upstream-side air-fuel ratio sensor.

30 Claims, 25 Drawing Sheets

| Fig. 6A | Fig. 6B | Fig. 6C |
|---|---|---|

LEAN
RICH
A/F
TDR
CDLY 0
t1
t2
t3
t4
t5
t6
t7
t8
TDL
A/F'
(F1)

TDR
(-TDL)
LEAN
RICH
TDR

RSL
KIR
FAF1
RSR
KIL

| Fig. 8 A | Fig. 8 B | Fig. 8 C |
|---|---|---|

XFC
"1"
"0"
$C_{max}$
$C_1$
0
"1"
"0"
$V_{R2}$
FAF2
RS2
K12
$V_2$
CFCR
XFCFB1
FUEL CUT-OFF
FUEL CUT-OFF
$t_0$
$t_1$
$t_2$
$t_3$
$t_4$
$t_5$
PRIOR ART
PRESENT INVENTION

| Fig. 11A | Fig. 11B | Fig. 11C |
|---|---|---|

| Fig. 14A |
| --- |
| Fig. 14 B |

XFC
"1"
"0"
$C_{max}$
$C_2$
$C_1$
0
"1"
"0"
"1"
"0"
$t_1$
$t_2$
$t_3$
$t_4$
$t_5$
$t_6$
$t_7$
$t_8$
$t_9$
$t_{10}$
$t_{11}$
$t_{12}$
$t_{13}$
FUEL CUT-OFF
CFCR
XFCFB1
XFCFB2
$V_2$
$V_{R2}$
RSR
ΔRS
PRIOR ART
PRESENT INVENTION

AIR-FUEL RATIO FEEDBACK CONTROL SYSTEM INCLUDING AT LEAST DOWNSTREAM-SIDE AIR-FUEL RATIO SENSOR

BACKGROUND OF THE INVENTION (1) Field of the Invention

The present invention relates to a method and apparatus for feedback control of an air-fuel ratio in an internal combustion engine having at least one air-fuel ratio sensor downstream of a catalyst converter disposed within an exhaust gas passage.

(2) Description of the Related Art

Generally, in a feedback control of the air-fuel ratio sensor ($O_2$ sensor) system, a base fuel amount TAUP is calculated in accordance with the detected intake air amount and detected engine speed, and the base fuel amount TAUP is corrected by an air-fuel ratio correction coefficient FAF which is calculated in accordance with the output of an air-fuel ratio sensor (for example, an $O_2$ sensor) for detecting the concentration of a specific component such as the oxygen component in the exhaust gas. Thus, an actual fuel amount is controlled in accordance with the corrected fuel amount. The above-mentioned process is repeated so that the air-fuel ratio of the engine is brought close to a stoichiometric air-fuel ratio.

According to this feedback control, the center of the controlled air-fuel ratio can be within a very small range of air-fuel ratios around the stoichiometric ratio required for three-way reducing and oxidizing catalysts (catalyst converter) which can remove three pollutants CO, HC, and $NO_X$ simultaneously from the exhaust gas.

In the above-mentioned $O_2$ sensor system where the $O_2$ sensor is disposed at a location near the concentration portion of an exhaust manifold, i.e., upstream of the catalyst converter, the accuracy of the controlled air-fuel ratio is affected by individual differences in the characteristics of the parts of the engine, such as the $O_2$ sensor, the fuel injection valves, the exhaust gas recirculation (EGR) valve, the valve lifters, individual changes due to the aging of these parts, environmental changes, and the like. That is, if the characteristics of the $O_2$ sensor fluctuate, or if the uniformity of the exhaust gas fluctuates, the accuracy of the air-fuel ratio feedback correction amount FAF is also fluctuated, thereby causing fluctuations in the controlled air-fuel ratio.

To compensate for the fluctuation of the controlled air-fuel ratio, double $O_2$ sensor systems have been suggested (see: U.S. Pat. Nos. 3,939,654, 4,027,477, 4,130,095, 4,235,204). In a double $O_2$ sensor system, another $O_2$ sensor is provided downstream of the catalyst converter, and thus an air-fuel ratio control operation is carried out by the downstream-side $O_2$ sensor is addition to an air-fuel ratio control operation carried out by the upstream-side $O_2$ sensor. In the double $O_2$ sensor system, although the downstream-side $O_2$ sensor has lower response speed characteristics when compared with the upstream-side $O_2$ sensor, the downstream-side $O_2$ sensor has an advantage in that the output fluctuation characteristics are small when compared with those of the upstream-side $O_2$ sensor, for the following reasons:

(1) On the downstream side of the catalyst converter, the temperature of the exhaust gas is low, so that the downstream-side $O_2$ sensor is not affected by a high temperature exhaust gas.

(2) On the downstream side of the catalyst converter, although various kinds of pollutants are trapped in the catalyst converter, these pollutants have little affect on the downstream side $O_2$ sensor.

(3) On the downstream side of the catalyst converter, the exhaust gas is mixed so that the concentration of oxygen in the exhaust gas is approximately in an equilibrium state.

Therefore, according to the double $O_2$ sensor system, the fluctuation of the output of the upstream-side $O_2$ sensor is compensated for by a feedback control using the output of the downstream-side $O_2$ sensor. Actually, as illustrated in FIG. 1, in the worst case, the deterioration of the output characteristics of the $O_2$ sensor in a single $O_2$ sensor system directly effects a deterioration in the emission characteristics. On the other hand, in a double $O_2$ sensor system, even when the output characteristics of the upstream-side $O_2$ sensor are deteriorated, the emission characteristics are not deteriorated. That is, in a double $O_2$ sensor system, even if only the output characteristics of the downstream-side $O_2$ are stable, good emission characteristics are still obtained.

In the above-mentioned double $O_2$ sensor system, for example, an air-fuel ratio feedback control parameter such as a rich skip amount RSR and/or a lean skip amount RSL is calculated in accordance with the output of the downstream-side $O_2$ sensor, and an air-fuel ratio correction amount FAF is calculated in accordance with the output of the upstream-side $O_2$ sensor and the air-fuel ratio feedback control parameter (see: U.S. Pat. No. 4,693,076). In this case, the air-fuel ratio feedback control parameter is stored in a backup random access memory (RAM). Therefore, when the downstream-side $O_2$ sensor is brought to a non-activation state, such as a fuel cut-off state, to stop the calculation of the air-fuel ratio feedback control parameter by the down- stream-side $O_2$ sensor, the air-fuel ratio correction amount FAF is calculated in accordance with the output of the upstream-side $O_2$ sensor and the air-fuel ratio feedback control parameter which was calculated in an activation state of the downstream-side $O_2$ sensor (i.e., an air-fuel ratio feedback control mode for the downstream-side $O_2$ sensor) and was stored in the backup RAM. Note that, in a fuel cut-off state, an air-fuel ratio feedback control for the upstream-side $O_2$ sensor is also prohibited.

In the above-mentioned double $O_2$ sensor system, the air-fuel ratio feedback control conditions for the downstream side $O_2$ sensor are as follows:

the coolant temperature is higher than a predetermined value;

the engine is not in an idling state;

the engine is not in a fuel cut-off state;

a secondary air suction system is not driven for forcibly causing the air-fuel ratio upstream of the catalyst converter;

the downstream-side $O_2$ sensor is in an activation state.

Other conditions may be introduced. Therefore, even when all the air-fuel ratio feedback conditions for the downstream-side $O_2$ sensor are satisfied, the downstream-side $O_2$ sensor may be not completely in an activation state or the $O_2$ storage effect of the three-way catalysts may remain. For example, when the engine is in a fuel cut-off state or in a lean driving state for forcibly causing the engine to be in a lean air-fuel ratio, regardless of the output of the $O_2$ sensors, the three-way catalysts absorb $O_2$ molecules, and therefore, immediately after the engine returns to a driving state of the stoichiometric air-fuel ratio, the three-way catalysts expel the stored $O_2$ molecules therefrom. This is a so-called $O_2$ storage effect. Particularly, at a descending driving mode, if racing occurs too frequently this invites fuel cut-off operations, and the $O_2$ storage effect is remarkably exhibited. As a result, even when the air-fuel ratio upstream of the catalyst converter is actually rich, the air-fuel ratio downstream of the catalyst converter is lean for a long time, so that the output of the downstream-side $O_2$ sensor indicates a lean state. Therefore, if an air-fuel ratio feedback control for the downstream-side $O_2$ sensor is carried out immediately after the engine is switched to a driving state of the stoichiometric air-fuel ratio, the air-fuel ratio feedback control parameter may be so large or small that an air-fuel ratio feedback control by the upstream-side $O_2$ sensor using the air-fuel ratio feedback control parameter produces an overrich air-fuel ratio, thus increasing the HC and CO emissions, and raising the fuel consumption. Particularly, in a system where the air-fuel ratio feedback control parameter is stored in the backup RAM in a fuel cut-off state or the like, as explained above, if frequent switching from a fuel cut-off state to a fuel cut-off recovery state and vice versa occurs, the controlled air-fuel ratio becomes further overrich, which means that an air-fuel ratio feedback control for the downstream-side $O_2$ sensor is meaningless.

The above-mentioned overrich air-fuel ratio problem is true for a single $O_2$ sensor system having only one $O_2$ sensor downstream of the catalyst converter.

SUMMARY OF THE INVENTION

It is an object of the present invention to provide an air-fuel ratio feedback control system including at least one air-fuel ratio sensor downstream of a catalyst converter, having improved exhaust emission and fuel consumption characteristics immediately after the control is transferred from an open-loop control mode, such as a fuel cut-off state, for a downstream-side air-fuel ratio sensor to an air-fuel ratio feedback control mode for the downstream-side air-fuel ratio sensor.

According to the present invention, when at least one of the air-fuel ratio feedback control conditions for the downstream-side air-fuel ratio sensor is not satisfied, the controlled air-fuel ratio is made an air-fuel ratio by an open loop control, while when all the air-fuel feedback control conditions for the downstream-side air-fuel ratio sensor are satisfied the controlled air-fuel ratio is made the stoichiometric ratio ($\lambda=1$) in accordance with the output of the downstream-side air-fuel ratio sensor. For a period after all the air-fuel ratio feedback control conditions for the downstream-side air-fuel ratio sensor are satisfied, the control by the output of the downstream-side air-fuel ratio sensor is prohibited, but the controlled air-fuel ratio is made the stoichiometric ratio ($\lambda=1$) by an open loop control or by the output of an upstream-side air-fuel ratio sensor. Thus, an overcorrection of an air-fuel ratio feedback amount such as an air-fuel ratio feedback parameter is avoided, thus improving the exhaust emission and fuel consumption characteristics.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Figure 1:
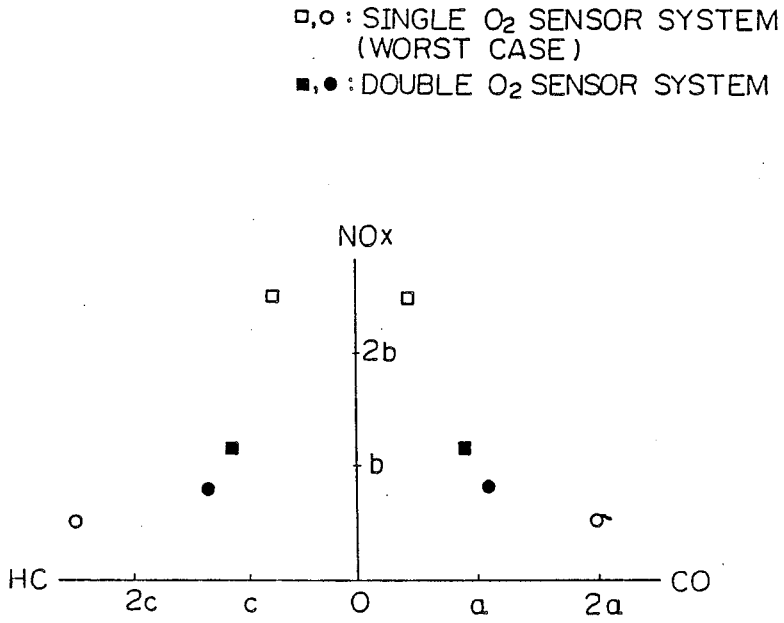
FIG. 1 is a graph showing the emission characteristics of a single $O_2$ sensor system and a double $O_2$ sensor system.
Figure 2:
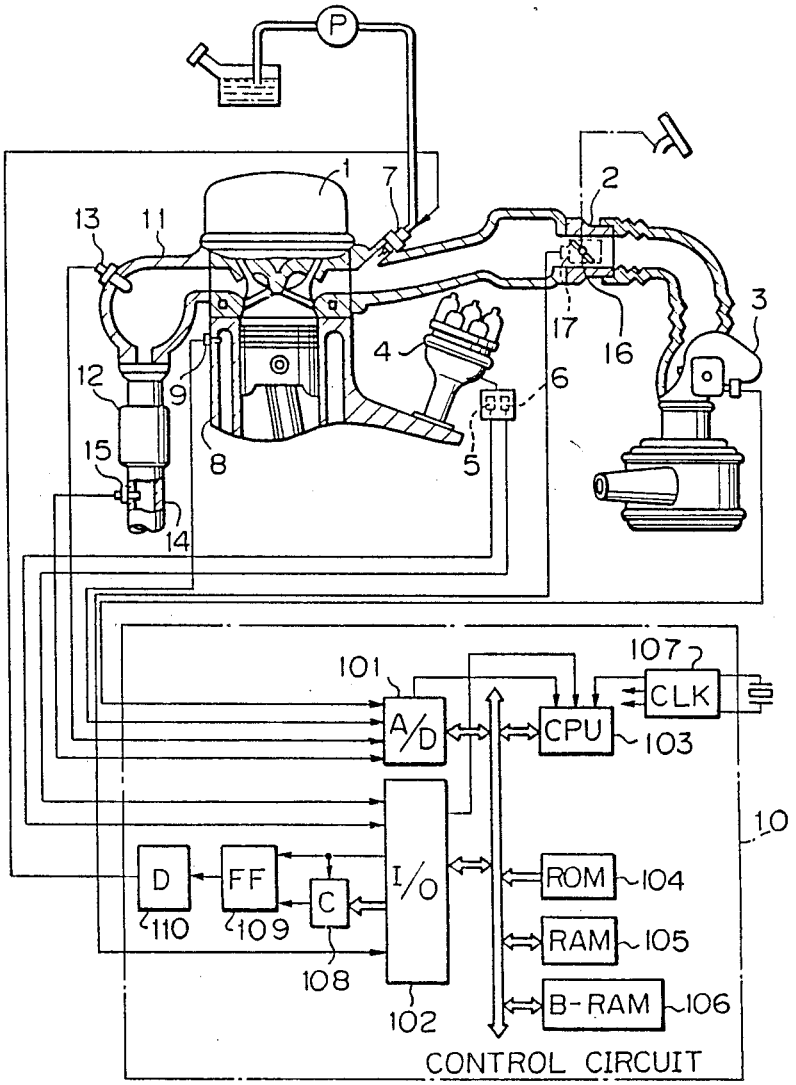
FIG. 2 is a schematic view of an internal combustion engine according to the present invention.

In FIG. 2, which illustrates an internal combustion engine according to the present invention, reference numeral 1 designates a four-cycle spark ignition engine disposed in an automotive vehicle. Provided in an air-intake passage 2 of the engine 1 is a potentiometer-type airflow meter 3 for detecting the amount of air drawn into the engine 1 to generate an analog voltage signal in proportion to the amount of air flowing therethrough. The signal of the airflow meter 3 is transmitted to a multiplexer-incorporating analog-to-digital (A/D) converter 101 of a control circuit 10.

Disposed in a distributor 4 are crank angle sensors 5 and 6 for detecting the angle of the crankshaft (not shown) of the engine 1.

In this case, the crank angle sensor 5 generates a pulse signal at every 720° crank angle (CA) and the crank-angle sensor 6 generates a pulse signal at every 30° CA. The pulse signals of the crank angle sensors 5 and 6 are supplied to an input/output (I/0) interface 102 of the control circuit 10. In addition, the pulse signal of the crank angle sensor 6 is then supplied to an interruption terminal of a central processing unit (CPU) 103.

Additionally provided in the air-intake passage 2 is a fuel injection valve 7 for supplying pressurized fuel from the fuel system to the air-intake port of the cylinder of the engine 1. In this case, other fuel injection valves are also provided for other cylinders, but are not shown in FIG. 2.

Disposed in a cylinder block 8 of the engine 1 is a coolant temperature sensor 9 for detecting the temperature of the coolant. The coolant temperature sensor 9 generates an analog voltage signal in response to the temperature THW of the coolant and transmits that signal to the A/D converter 101 of the control circuit 10.

Provided in an exhaust system on the downstream-side of an exhaust manifold 11 is a three-way reducing and oxidizing catalyst converter 12 which removes three pollutants CO, HC, and $NO_X$ simultaneously from the exhaust gas.

Provided on the concentration portion of the exhaust manifold 11, i.e., upstream of the catalyst converter 12, is a first $O_2$ sensor 13 for detecting the concentration of oxygen composition in the exhaust gas. Further, provided in an exhaust pipe 14 downstream of the catalyst converter 12 is a second $O_2$ sensor 15 for detecting the concentration of oxygen composition in the exhaust gas.

The $O_2$ sensors 13 and 15 generate output voltage signals and transmit those signals to the A/D converter 101 of the control circuit 10.

Reference 16 designates a throttle valve, and 17 an idle switch for detecting whether or not the throttle valve 16 is completely closed.

Also, a secondary air suction system may be provided on the upstream side of the catalyst converter 12. When the engine is in an deceleration state, the secondary air suction system is driven to supply air to the upstream side of the catalyst converter 13, so as to make the air-fuel ratio on the upstream side and downstream side of the catalyst converter 13 lean, thus cleaning HC and CO emissions.

The control circuit 10, which may be constructed by a microcomputer, further comprises a central processing unit (CPU) 103, a read-only memory (ROM) 104 for storing a main routine and interrupt routines such as a fuel injection routine, an ignition timing routine, tables (maps), constants, etc., a random access memory 105 (RAM) for storing temporary data, a backup RAM 106, a clock generator 107 for generating various clock signals, a down counter 108, a flip-flop 109, a driver circuit 110, and the like.

Note that the battery (not shown) is connected directly to the backup RAM 106 and, therefore, the content thereof is not erased even when the ignition switch (not shown) is turned OFF.

The down counter 108, the flip-flop 109, and the driver circuit 110 are used for controlling the fuel injection valve 7. That is, when a fuel injection amount TAU is calculated in a TAU routine, which will be later explained, the amount TAU is preset in the down counter 108, and simultaneously, the flip-flop 109 is set. As a result, the driver circuit 110 initiates the activation of the fuel injection valve 7. On the other hand, the down counter 108 counts up the clock signal from the clock generator 107, and finally generates a logic "1" signal from the carry-out terminal of the down counter 108, to reset the flip-flop 109, so that the driver circuit 110 stops the activation of the fuel injection valve 7. Thus, the amount of fuel corresponding to the fuel injection amount TAU is injected into the fuel injection valve 7.

Interruptions occur at the CPU 013 when the A/D converter 101 completes an A/D conversion and generates an interrupt signal; when the crank angle sensor 6 generates a pulse signal; and when the clock generator 107 generates a special clock signal.

The intake air amount data Q of the airflow meter 3 and the coolant temperature data THW of the coolant sensor 9 are fetched by an A/D conversion routine(s) executed at every predetermined time period and are then stored in the RAM 105. That is, the data Q and THW in the RAM 105 are renewed at every predetermined time period. The engine speed Ne is calculated by an interrupt routine executed at 30° CA, i.e., at every pulse signal of the crank angle sensor 6, and is then stored in the RAM 105.

First, a relationship between a fuel cut-off state and the output $V_2$ of the downstream-side $O_2$ sensor 15 will be explained with reference to FIG. 3. That is, every time the engine is brought to a fuel cut-off state (XFC="1"), the output $V_2$ of the downstream-side $O_2$ sensor 15 becomes low (lean), but in this case, a delay $D_1$ occurs in the output $V_2$ of the downstream-side $O_2$ sensor 15 due to the delay in the transport of the exhaust gas, since the downstream-side $O_2$ sensor 15 is located downstream of the catalyst converter 12. On the other hand, every time the engine is brought to a fuel cut-off recovery state (XFC="0"), the output $V_2$ of the downstream-side $O_2$ sensor 15 becomes high (rich), but in this case, a large delay D2 occurs in the output $V_2$ of the downstream-side $O_2$ sensor 15 due to the $O_2$ storage effect in addition to the delay in the transport of the exhaust gas. Therefore, when the air-fuel ratio upstream of the catalyst converter is actually rich, an air-fuel ratio feedback control parameter such as a rich skip amount and/or a lean skip amount is overcorrected to the rich side. That is, if the $O_2$ storage effect of the catalyst converter does not exist, the output $V_2$ of the downstream-side $O_2$ sensor 15 is changed as indicated by a dotted line, but it is actually changed as indicated by a solid line. Particularly, when racing occurs at a descending mode so as to invite frequent fuel cut-off operations as indicated by an arrow X. In this case, the overcorrection of the air-fuel ratio feedback control parameter to the rich side is accumulated, thus increasing HC and CO emissions, and raising the fuel consumption.

According to the present invention, for a definite time period after the engine is switched from a fuel cut-off state to a fuel cut-off recovery state, an air-fuel ratio feedback control for the downstream-side $O_2$ sensor 15 is prohibited, thus avoiding the overcorrection of the air-fuel ratio. Also, even when fuel cut-off operations are frequently carried out, such an air-fuel ratio feedback control is prohibited, thus avoiding the accumulation of overcorrection of the air-fuel ratio.

The operation of the control circuit 10 of FIG. 2 will be now explained.

Figure 5:
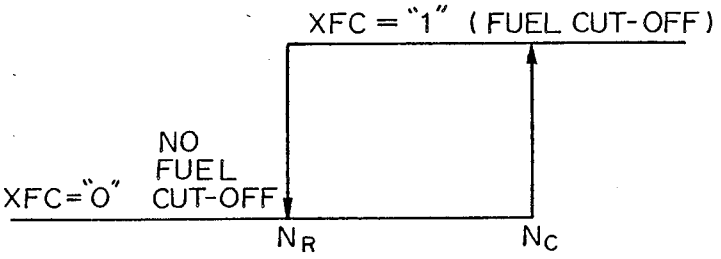
FIG. 5 is a graph showing the characteristics of the fuel cut-off flag FC of FIG. 4.
Figure 4:
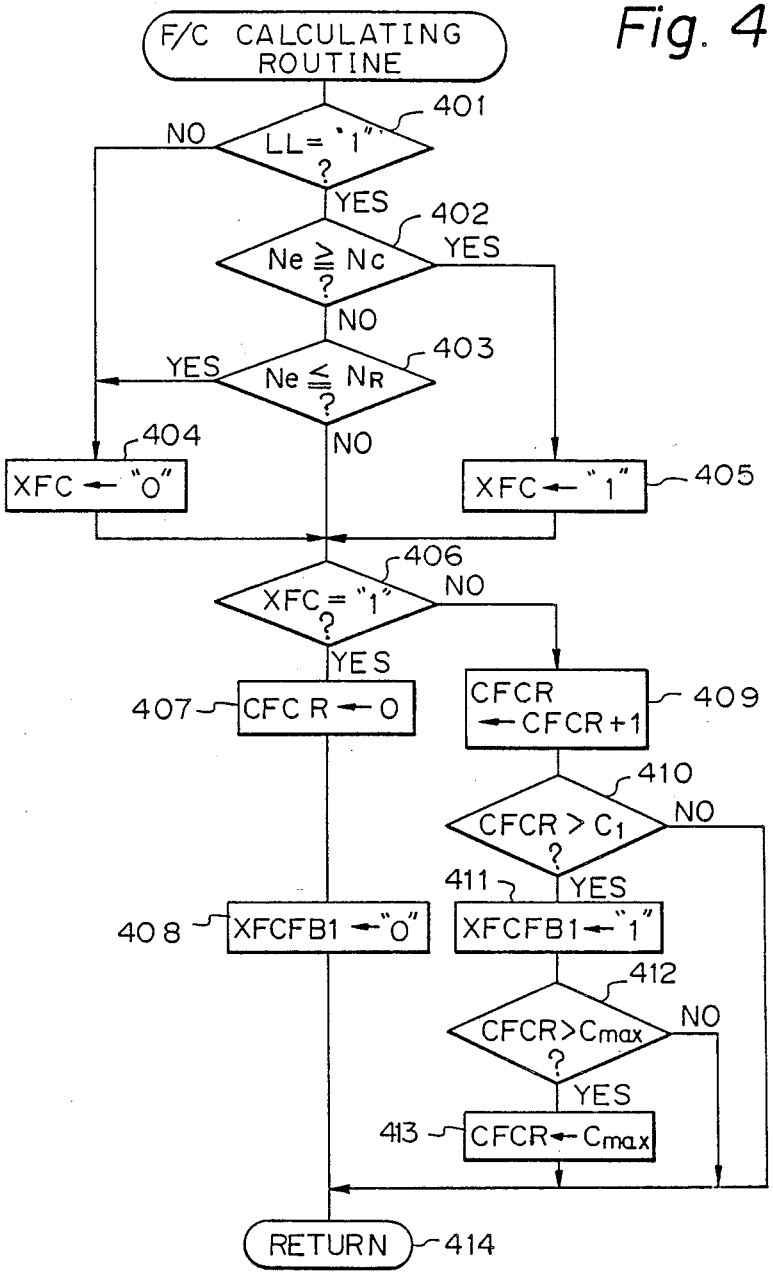
FIGS. 4, 6, 6A–6C, 7, 8A–8C, 9, 11, 11A–11C, 12, 14, 14A, 14B, 15, 18, and 19 are flow charts showing the operation of the control circuit of FIG. 2.

In FIG. 4, which is a routine for calculating a fuel cut-off flag XFC executed at every predetermined time period such as 4 ms, a flag XFC as shown in FIG. 5 is calculated. In FIG. 5, $N_c$ designates a fuel cut-off engine speed, and $N_R$ designates a fuel cut-off recovery engine speed. All of the values $N_c$ and $N_R$ are dependent upon the engine coolant temperature THW.

At step 401, it is determined whether or not the output signal LL of the idle switch 17 is "1", i.e., whether or not the engine 1 is in an idling state. If in an idling state, at step 402, the engine speed $N_e$ is read out of the RAM 105, and is compared with the fuel cut-off engine speed $N_c$, and at step 403, the engine speed $N_e$ is compared with the fuel cut-off recovery engine speed $N_R$. As a result, if $N_e \geqq N_c$, the control proceeds to step 404, which sets the flag XFC, i.e., XFC+"1". If $N_e \leqq N_R$, the control proceeds to step 405 which resets the flag XFC. If $N_R < N_e < N_c$, the control proceeds directly to step 406, so that the flag XFC is unchanged, and accordingly, remains at the previous state.

If not in an idling state at step 401, the control jumps to step 404.

At steps 406 to 413, an execution flag XFCFBl for an air-fuel ratio feedback control for the output $V_2$ of the downstream-side $O_2$ sensor 15 is calculated. Note that the execution flag XFCFBl is reset by the initial routine (not shown).

At step 406, it is determined whether or not the fuel cut-off flag XFC is "1", i.e., whether the engine is in a fuel cut-off state. As a result, if XFC="1" (fuel cut-off state), the control proceeds to step 407 which clears a duration counter value CFCR for counting a time duration after the engine becomes in a fuel cut-off recovery state, and at step 408, the execution flag XFCFBl is reset. Then, the control proceeds to step 414.

On the other hand, at step 406, if XFC="0" (fuel cut-off recovery state), the control proceeds to step 409 which counts up the value CFCR by +1. Then at step 410, it is determined whether or not CFCR<$C_1$ (definite value) is satisfied, i.e., whether or not the time duration after the fuel cut-off recovery reaches a definite time period (=$C_1$×4 ms). As a result, only when CFCR<$C_1$, does the control proceed to step 411 which sets the execution flag XFCFBl. The counter value CFCR is guarded at steps 412 and 413 by a maximum value $C_{max}$.

This routine is completed by step 414.

Thus, for a definite time period defined by $C_1$×4 ms after the engine becomes in a fuel cut-off recovery state, the execution flag XFCFBl is set thereby carrying out an air-fuel ratio feedback control for the downstream-side $O_2$ sensor 15, which will be later explained.

Figures 6, 6A:
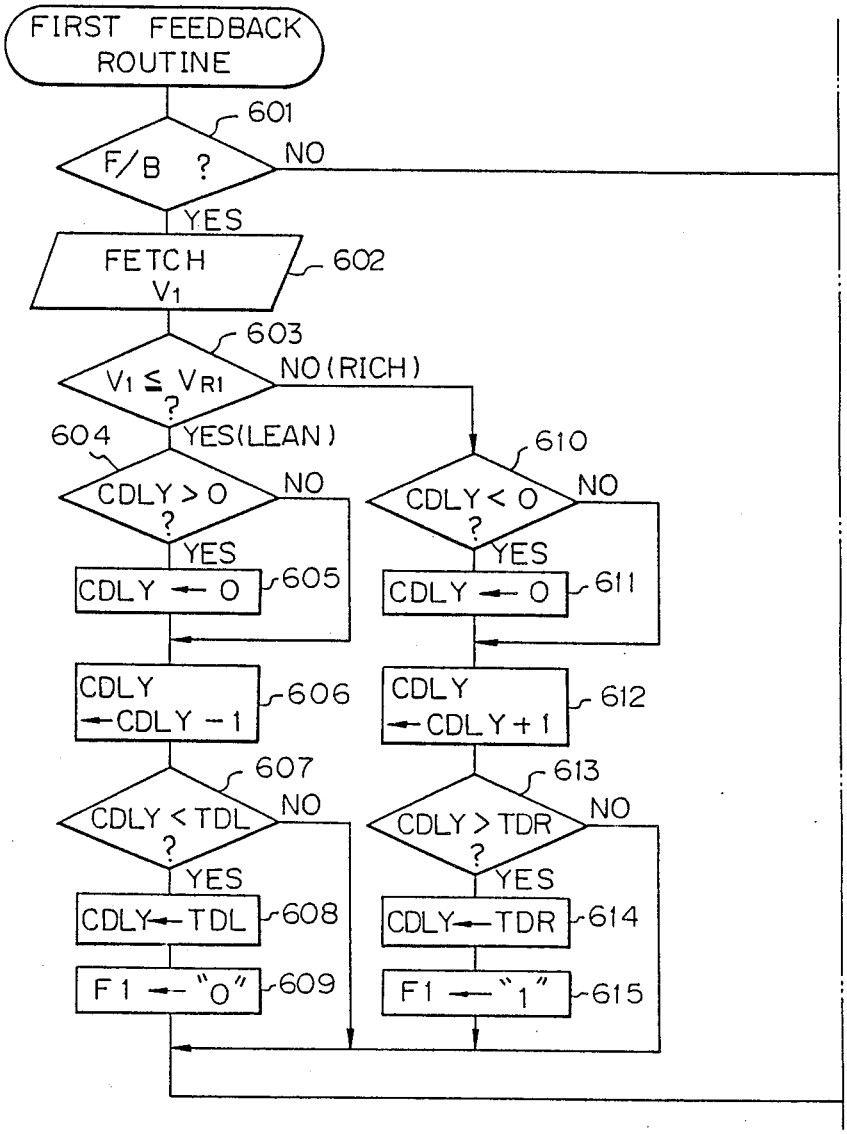
Figure 6B:
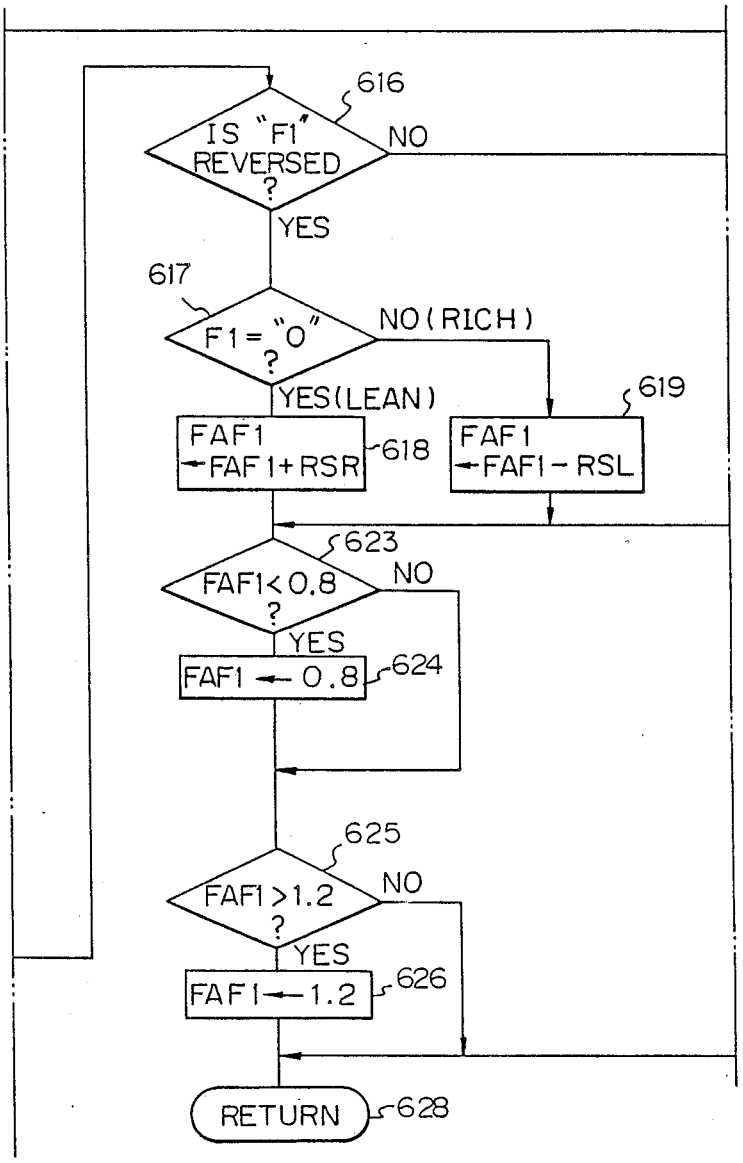
Figure 6C:
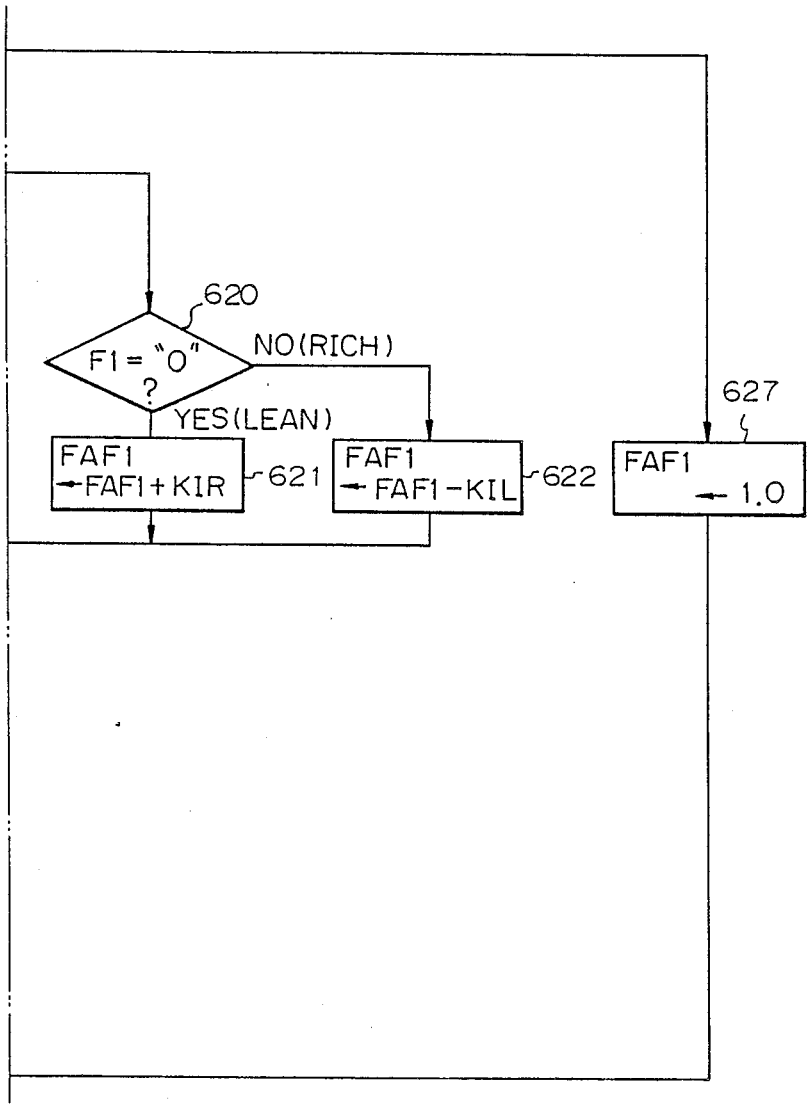

FIG. 6 is a routine for calculating a first air-fuel ratio feedback correction amount FAF1 in accordance with output of the upstream-side $O_2$ sensor 13 executed at every predetermined time period such as 4 ms.

At step 601, it is determined whether or not all of the feedback control (closed-loop control) conditions by the upstream-side $O_2$ sensor 13 are satisfied. The feedback control conditions are as follows:

(i) the engine is not in a fuel cut-off state (XFC="0");

(ii) the engine is not in a starting state;

(iii) the coolant temperature THW is higher than 50° C.;

(iv) the power fuel incremental amount FPOWER is 0; and (v) the upstream-side $O_2$ sensor 13 is in an activated state.

Note that the determination of activation/nonactivation of the upstream-side $O_2$ sensor 13 is carried out by determining whether or not the coolant temperature THW≧70° C., or by whether or not the output of the upstream-side $O_2$ sensor 13 is once swung, i.e., once changed from the rich side to the lean side, or vice versa. Of course, other feedback control conditions are introduced as occasion demands. However, an explanation of such other feedback control conditions is omitted.

If one of more of the feedback control conditions is not satisfied, the control proceeds to step 627, in which the amount FAF1 is caused to be 1.0 (FAF1=1.0), thereby carrying out an open-loop control operation. Note that, in this case, the amount FAF1 can be a value or a mean value immediately before the open-loop control operation. That is, the amount FAF1 or a mean value $\overline{FAF1}$ thereof is stored in the backup RAM 106, and in an open-loop control operation, the value FAF1 or $\overline{FAF1}$ is read out of the backup RAM 106.

Contrary to the above, at step 601, if all of the feedback control conditions are satisfied, the control proceeds to step 602.

At step 602, an A/D conversion is performed upon the output voltage $V_1$ of the upstream-side $O_2$ sensor 13, and the A/D converted value thereof is then fetched from the A/D converter 101. Then at step 603, the voltage $V_1$ is compared with a reference voltage $V_{Rl}$ such as 0.45 V, thereby determining whether the current air-fuel ratio detected by the upstream-side $O_2$ sensor 13 is on the rich side or on the lean side with respect to the stoichiometric air-fuel ratio.

If $V_1 \leqq V_{Rl}$, which means that the current air-fuel ratio is lean, the control proceeds to step 604, which determines whether or not the value of a delay counter CDLY is positive. If CDLY>0, the control proceeds to step 605, which clears the delay counter CDLY, and then proceeds to step 606. If CDLY≦0, the control proceeds directly to step 606. At step 606, the delay counter CDLY is counted down by 1, and at step 607, it is determined whether or not CDLY<TDL. Note that TDL is a lean delay time period for which a rich state is maintained even after the output of the upstream-side $O_2$ sensor 13 is changed from the rich side to the lean side, and is defined by a negative value. Therefore, at step 607, only when CDLY<TDL does the control proceed to step 608, which causes CDLY to be TDL, and then to step 609, which causes a first air-fuel ratio flag Fl to be "0" (lean state). On the other hand, if $V_1 > V_{Rl}$, which means that the current air-fuel ratio is rich, the control proceeds to step 610, which determines whether or not the value of the delay counter CDLY is negative. If CDLY<0, the control proceeds to step 611, which clears the delay counter CDLY, and then proceeds to step 612. If CDLY>0, the control directly proceeds to 612. At step 612, the delay counter CDLY is counted up by 1, and at step 613, it is determined whether or not CDLY<TDR. Note that TDR is a rich delay time period for which a lean state is maintained even after the output of the upstream-side $O_2$ sensor 13 is changed from the lean side to the rich side, and is defined by a positive value. Therefore, at step 613, only when CDLY TDR does the control proceed to step 614, which causes CDLY to TDR, and then to step 615, which causes the first air-fuel ratio flag Fl to be "1" (rich state).

Next, at step 616, it is determined whether or not the first air-fuel ratio flag Fl is reversed, i.e., whether or not the delayed air-fuel ratio detected by the upstream-side $O_2$ sensor 13 is reversed. If the first air-fuel ratio flag Fl is reversed, the control proceeds to steps 617 to 619, which carry out a skip operation.

At step 617, if the flag Fl is "0" (lean), the control proceeds to step 618, which remarkably increases the correction amount FAF1 by a skip amount RSR. Also, if the flag Fl is "1" (rich) at step 617, the control proceeds to step 619, which remarkably decreases the correction amount FAF1 by a skip amount RSL.

On the other hand, if the first air-fuel ratio flag Fl is not reversed at step 616, the control proceeds to steps 620 to 622, which carries out an integration operation. That is, if the flag Fl is "0" (lean) at step 620, the control proceeds to step 621, which gradually increases the correction amount FAF1 by a rich integration amount KIR. Also, if the flag Fl is "1" (rich) at step 620, the control proceeds to step 622, which gradually decreases the correction amount FAF1 by a lean integration amount KIL.

The correction amount FAF1 is guarded by a minimum value 0.8 at steps 623 and 624. Also, the correction amount FAF1 is guarded by a maximum value 1.2 at steps 625 and 626. Thus, the controlled air-fuel ratio is prevented from becoming overlean or overrich.

The correction amount FAF1 is then stored in the RAM 105, thus completing this routine of FIG. 6 at steps 628.

Figures 7A, 7B, 7C, 7D:
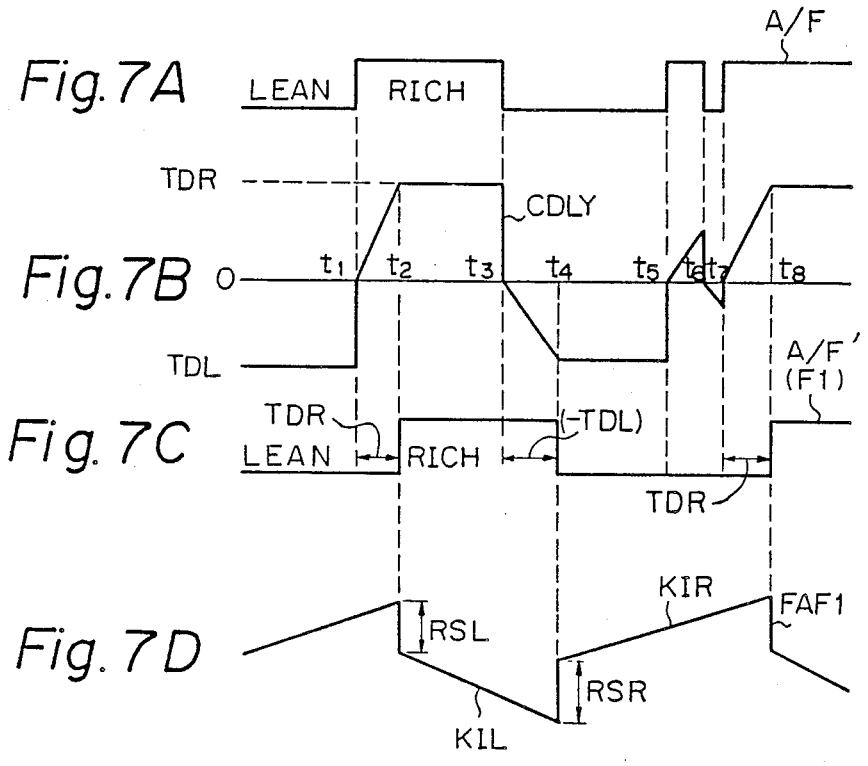
FIGS. 7A through 7D are timing diagrams explaining the flow chart of FIG. 5.

The operation by the flow chart of FIG. 6 will be further explained with reference to FIGS. 7A through 7D. As illustrated in FIG. 7A, when the air-fuel ratio A/F is obtained by the output of the upstream-side $O_2$ sensor 13, the delay counter CDIY is counted up during a rich state, and is counted down during a lean state, as illustrated in FIG. 7B. As a result, a delayed air-fuel ratio corresponding to the first air-fuel ratio flag Fl is obtained as illustrated in FIG. 7C. For example, at time $t_1$, even when the air-fuel ratio A/F is changed from the lean side to the rich side, the delayed air-fuel ratio A/F' (Fl) is changed at time $t_2$ after the rich delay time period TDR. Similarly, at time $t_3$, even when the air-fuel ratio A/F is changed from the rich side to the lean side, the delayed air-fuel ratio Fl' is changed at time $t_4$ after the lean delay time period TDL. However, at time $t_5$, $t_6$, or $t_7$, when the air-fuel ratio A/F is reversed within a shorter time period than the rich delay time period TDR or the lean delay time period TDI, the delay air-fuel ratio A/F' is reversed at time t8 That is, the delayed air-fuel ratio A/F' is stable when compared with the air-fuel ratio A/F. Further, as illustrated in FIG. 7D, at every change of the delayed air-fuel ratio A/F' from the rich side to the lean side, or vice versa, the correction amount FAF is skipped by the skip amount RSR or RSL, and in addition, the correction amount FAF1 is gradually increased or decreased in accordance with the delayed air-fuel ratio A/F'.

Air-fuel ratio feedback control operations by the downstream-side $O_2$ sensor 15 will be explained. There are two types of air-fuel ratio feedback control operations by the downstream-side $O_2$ sensor 15, i.e., the operation type in which a second air-fuel ratio correction amount FAF2 is introduced thereinto, and the operation type in which an air-fuel ratio feedback control parameter in the air-fuel ratio feedback control operation by the upstream-side $O_2$ sensor 13 is variable. Further, as the air-fuel ratio feedback control parameter, there are nominated a delay time period TD (in more detail, the rich delay time period TDR and the lean delay time period TDL), a skip amount RS (in more detail, the rich skip amount RSR and the lean skip amount RSL), an integration amount KI (in more detail, the rich integration amount KIR and the lean integration amount KIL), and the reference voltage $V_{Rl}$.

For example, if the rich delay time period becomes longer than the lean delay time period (TDR>(−TDL)), the controlled air-fuel becomes richer, and if the lean delay time period becomes longer than the rich delay time period ((−TDL)>TDR), the controlled air-fuel ratio becomes leaner. Thus, the air-fuel ratio can be controlled by changing the rich delay time period TDR1 and the lean delay time period (−TDL) in accordance with the output of the downstream-side $O_2$ sensor 15. Also, if the rich skip amount RSR is increased or if the lean skip amount RSL is decreased, the controlled air-fuel ratio becomes richer, and if the lean skip amount RSL is increased or if the rich skip amount RSR is decreased, the controlled air-fuel ratio becomes leaner. Thus, the air-fuel ratio can be controlled by changing the rich skip amount RSR and the lean skip amount RSL in accordance with the output downstream-side $O_2$ sensor. Further, if the rich integration amount KIR is increased or if the lean integration amount KIL is decreased, the controlled air-fuel ratio becomes richer, and if the lean integration amount KIL is increased or if the rich integration amount KIR is decreased, the controlled air-fuel ratio becomes leaner. Thus, the air-fuel ratio can be controlled by changing the rich integration amount KIR and the lean integration amount KIL in accordance with the output of the downstream-side $O_2$ sensor 15. Still further, if the reference voltage $V_{Rl}$ is increased, the controlled air-fuel ratio becomes richer, and if the reference voltage $V_{Rl}$ is decreased, the controlled air-fuel ratio becomes leaner. Thus, the air-fuel ratio can be controlled by changing the reference voltage $V_{Rl}$ in accordance with the output of the downstream-side $O_2$ sensor 15.

There are various merits in the control of the air-fuel ratio feedback control parameters by the output $V_2$ of the downstream-side $O_2$ sensor 15. For example, when the delay time periods TDR and TDL are controlled by the output $V_2$ of the downstream-side $O_2$ sensor 15, it is possible to precisely control the air-fuel ratio. Also, when the skip amounts RSR and RSL are controlled by the output $V_2$ of the downstream-side $O_2$ sensor 15, it is possible to improve the response speed of the air-fuel ratio feedback control by the output $V_2$ of the downstream-side $O_2$ sensor 15. Of course, it is possible to simultaneously control two or more kinds of the air-fuel ratio feedback control parameters by the output $V_2$ of the downstream-side $O_2$ sensor 15.

A double $O_2$ sensor system into which a second air-fuel ratio correction amount FAF2 is introduced will be explained with reference to FIGS. 8 and 9.

Figures 7, 8A:
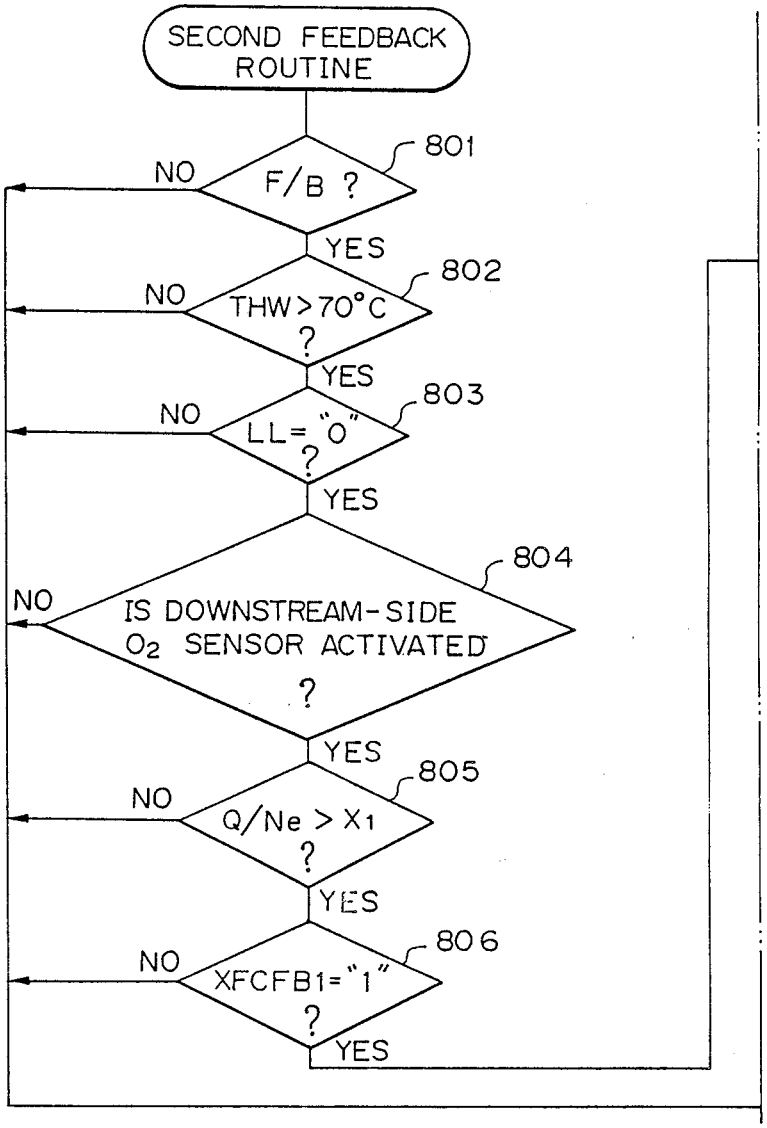
Figure 8B:
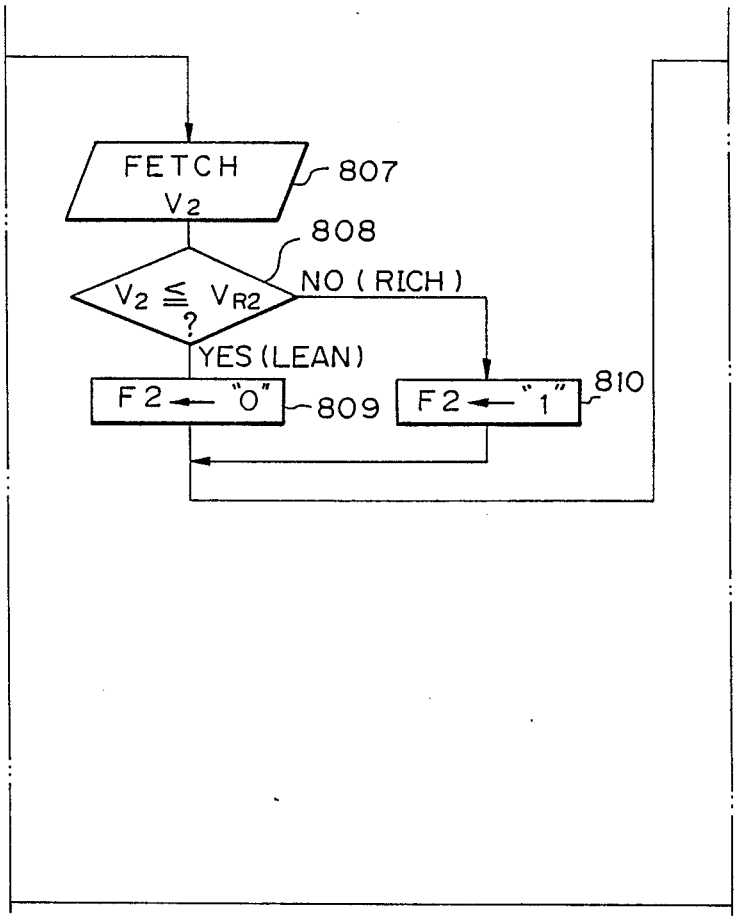
Figure 8C:
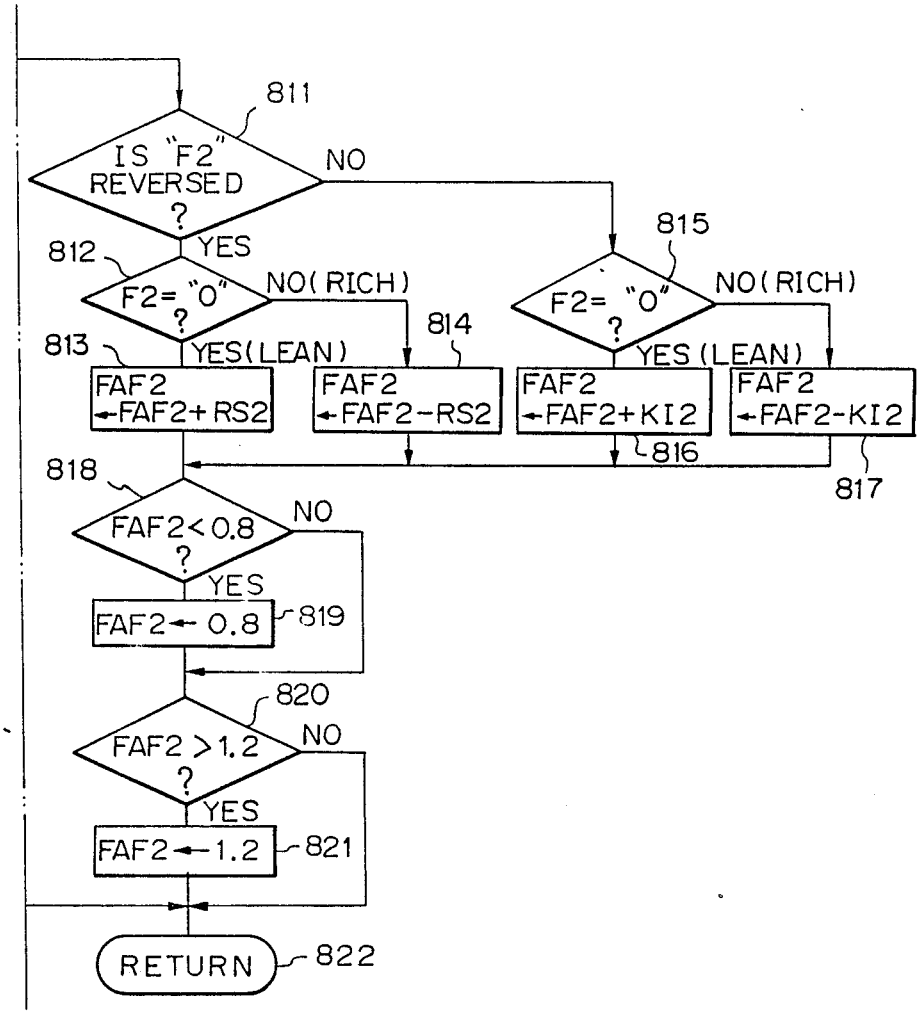

FIG. 8 is a routine for calculating a second air-fuel ratio feedback correction amount FAF2 in accordance with the output of the downstream-side $O_2$ sensor 15 executed at every predetermined time period such as 1 s.

At steps 801 through 805, it is determined whether or not all of the feedback control (closed-loop control) conditions by the downstream-side $O_2$ sensor 15 are satisfied. For example, at step 801, it is determined whether or not the feedback control conditions by the upstream-side $O_2$ sensor 13 are satisfied. At step 802, it is determined whether or not the coolant temperature THW is higher than 70° C. At step 803, it is determined whether or not the throttle valve 16 is open (LL="0"). At step 804, it is determined whether or not the output $V_2$ of the downstream-side $O_2$ sensor 15 has been once changed from the lean side to the rich side or vice versa. At step 805, it is determined whether or not a load parameter such as Q/Ne is larger than a predetermined value $X_1$. Of course, other feedback control conditions are introduced as occasion demands. For example, a condition whether or not the secondary air suction system is driven when the engine is in a deceleration state. However, an explanation of such other feedback control conditions is omitted.

If one or more of the feedback control conditions is not satisfied, the control directly proceeds to step 822, thereby carrying out an open-loop control operation. Note that, in this case, the amount FAF2 or a mean value $\overline{FAF2}$ thereof is stored in the backup RAM 106, and in an open-loop control operation, the value FAF2 or $\overline{FAF2}$ is read out of the backup RAM 106.

Contrary to the above, if all of the feedback control conditions are satisfied, the control proceeds to step 806. At step 806, it is determined whether or not the execution flag XFCFBl for an air-fuel ratio feedback control for the downstream-side $O_2$ sensor 15 is "1". Only if XFCFBl is "1", the control proceeds to steps 807 through 821.

At step 807, an A/D conversion is performed upon the output voltage $V_2$ of the downstream-side $O_2$ sensor 15, and the A/D converted value thereof is then fetched from the A/D converter 101. Then, at step 808, the voltage $V_2$ is compared with a reference voltage $V_{R2}$ such as 0.55 V, thereby determining whether the current air-fuel ratio detected by the downstream-side $O_2$ sensor 15 is on the rich side or on the lean side with respect to the stoichiometric air-fuel ratio. Note that the reference voltage $V_{R2}$ (=0.55 V) is preferably higher than the reference voltage $V_{R1}$ (=0.45 V), in consideration of the difference in output characteristics and deterioration speed between the $O_2$ sensor 13 upstream of the catalyst converter 12 and the $O_2$ sensor 15 downstream of the catalyst converter 12. However, the voltage $V_{R2}$ can be voluntarily determined.

At step 808, if the air-fuel ratio downstream the catalyst converter 12 is lean, the control proceeds to step 809 which resets a second air-fuel ratio flag F2. Alternatively, the control proceeds to the step 810, which sets the second air-fuel ratio flag F2.

Next, at step 811, it is determined whether or not the second air-fuel ratio flag F2 is reversed. If the second air-fuel ratio flag F2 is reversed, the control proceeds to steps 812 to 814 which carry out a skip operation. That is, if the flag F2 is "0" (lean) at step 812, the control proceeds to step 813, which remarkably increases the second correction amount FAF2 by a skip amount RS2. Also, if the flag F2 is "1" (rich) at step 812, the control proceeds to step 813, which remarkably decreases the second correction amount FAF2 by the skip amount RS2. On the other hand, if the second air-fuel ratio flag F2 is not reversed at step 811, the control proceeds to steps 815 to 817, which carry out an integration operation. That is, if the flag F2 is "0" (lean) at step 815, the control proceeds to step 816, which gradually increases the second correction amount FAF2 by an integration amount KI2. Also, if the flag F2 is "1" (rich) at step 816, the control proceeds to step 817, which gradually decreases the second correction amount FAF2 by the integration amount KI2.

Note that the skip amount RS2 is larger than the integration amount KI2.

The second correction amount FAF2 is guarded by a minimum value 0.8 at steps 818 and 819, and by a maximum value 1.2 at steps 820 and 821, thereby also preventing the controlled air-fuel ratio from becoming overrich or overlean.

The correction amount FAF2 is then stored in the backup RAM 106, thus completing this routine of FIG. 8 at step 822.

Figure 9:
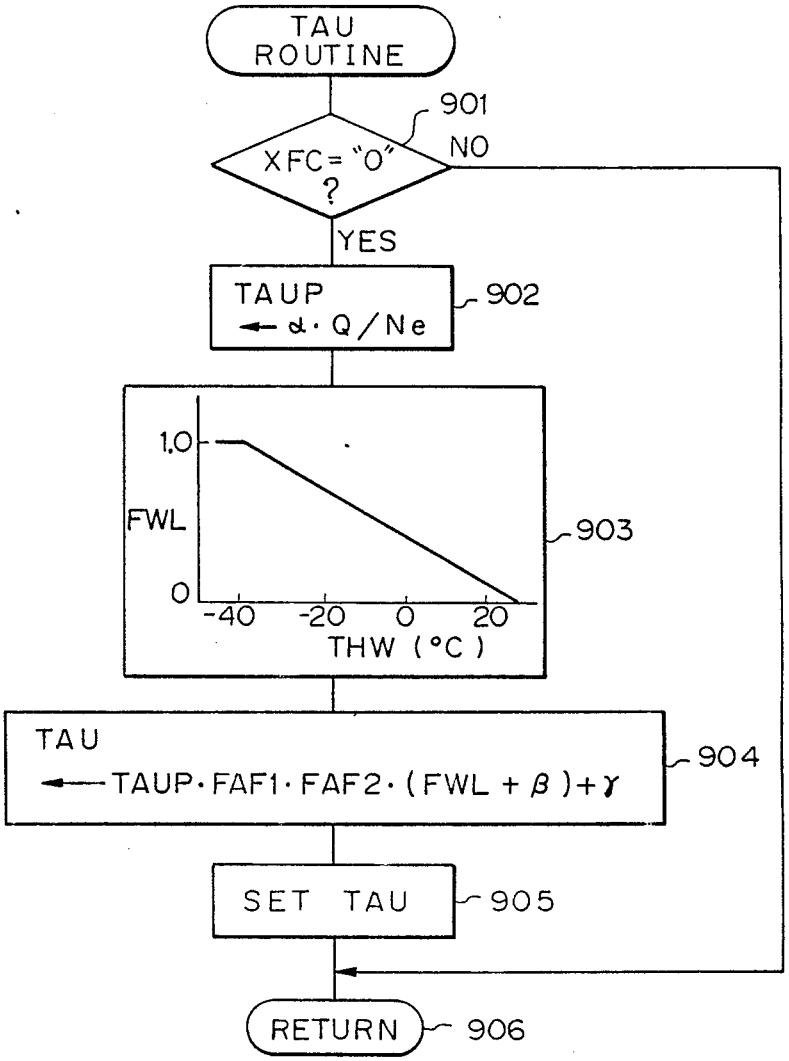

FIG. 9 is a routine for calculating a fuel injection amount TAU executed at every predetermined crank angle such as 360° CA. At step 901, it is determined whether or not the fuel cut-off flag XFC is "1". As a result, if XFC="1", the control proceeds directly to step 906, thereby carrying out a fuel cut-off operation. On the other hand, if XFC="0" at step 901, the control proceeds to steps 902 through 905.

At step 902, a base fuel injection amount TAUP is calculated by using the intake air amount data Q and the engine speed data Ne stored in the RAM 105. That is, $$TAUP \leftarrow \alpha \cdot Q/Ne$$

where $\alpha$ is a constant. Then at step 903, a warming-up incremental amount FWI is calculated from a one-dimensional map stored in the ROM 104 by using the coolant temperature data THW stored in the RAM 105. Note that the warming-up incremental amount FWL decreases when the coolant temperature THW increases. At step 904, a final fuel injection amount TAU is calculated by $$TAU \leftarrow TAUP \cdot FAF1 \cdot FAF2 \cdot (FWL+\beta)+\gamma$$

where $\beta$ and $\gamma$ are correction factors determined by other parameters such as the voltage of the battery and the temperature of the intake air. At step 905, the final fuel injection amount TAU is set in the down counter 107, and in addition, the flip-flop 108 is set to initiate the activation of the fuel injection valve 7. Then, this routine is completed by step 906. Note that, as explained above, when a time period corresponding to the amount TAU has passed, the flip-flop 109 is reset by the carry-out signal of the down counter 108 to stop the activation of the fuel injection valve 7.

The routines of FIGS. 4, 6, 8, and 9 will be further explained with reference to FIG. 10. For a time period from $t_0$ to $t_1$ and a time period from $t_3$ to $t_4$, since a fuel cut-off operation is carried out (XFC="1"), the duration counter value CFCR remains at 0, and accordingly, the execution flag XFCFBl remains at "0". Further, air-fuel ratio feedback controls for the upstream-side and downstream-side $O_2$ sensors 13 and 15 are both prohibited, i.e., an open-loop control for a lean air-fuel ratio is carried out. In this case, the output $V_2$ of the downstream-side $O_2$ sensor 15 indicates a lean signal (low level), and the second air-fuel ratio correction amount FAF2 remains at a value immediately before the fuel cut-off operation.

Next, at time $t_1$ or $t_4$, when a fuel cut-off recovery state (XFC="0") is established to initiate the counting up of the duration counter value CFCR, the air-fuel ratio feedback control for the downstream-side $O_2$ sensor 15 is still prohibited before the duration counter value CFCR reaches the value $C_1$. That is, the second air-fuel ratio correction amount FAF2 is unchanged. Note that, in this case, since an air-fuel ratio feedback control for the upstream-side $O_2$ sensor 13 is carried out, the controlled air-fuel ratio is brought close to the stoichiometric air-fuel ratio.

Further, at time $t_2$ or $t_5$, when the duration counter value CFCR reaches the value $C_1$, the execution flag XFCFBl is set to thus initiate an air-fuel ratio feedback control for the output $V_2$ of the downstream-side $O_2$ sensor 15, i.e., calculating the second air-fuel ratio correction amount FAF2 in accordance with the output $V_2$ of the downstream-side $O_2$ sensor 15. Therefore, in this case, the air-fuel ratio feedback control for the output $V_1$ of the upstream-side $O_2$ sensor 13 and the air-fuel ratio feedback control for the output $V_2$ of the downstream-side $O_2$ sensor 15 are both carried out.

Thus, for a predetermined time period ($C_1 \times 4$ ms) after the fuel cut-off recovery, the renewal of the second air-fuel ratio correction amount FAF2 is prohibited. Note that, if the renewal of the second air-fuel ratio correction amount FAF2 is initiated immediately after the fuel cut-off recovery as in the prior art, the second air-fuel ratio correction amount FAF2 is overcorrected as indicated by a dotted line, thus increasing HC and CO emissions.

A double $O_2$ sensor system, in which an air-fuel ratio feedback control parameter of the first air-fuel ratio feedback control by the upstream-side $O_2$ sensor is variable, will be explained with reference to FIG. 11. In this case, the skip amounts RSR and RSL as the air-fuel ratio feedback control parameters are variable.

Figures 11, 11A:
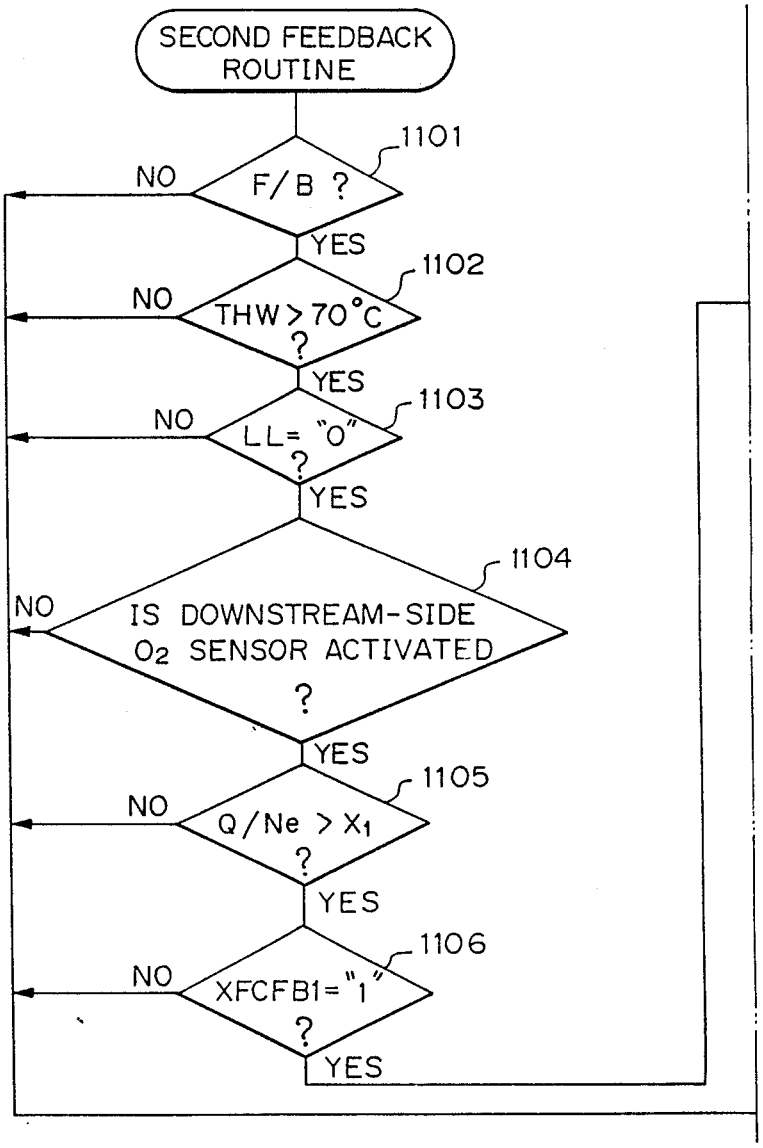
Figure 11B:
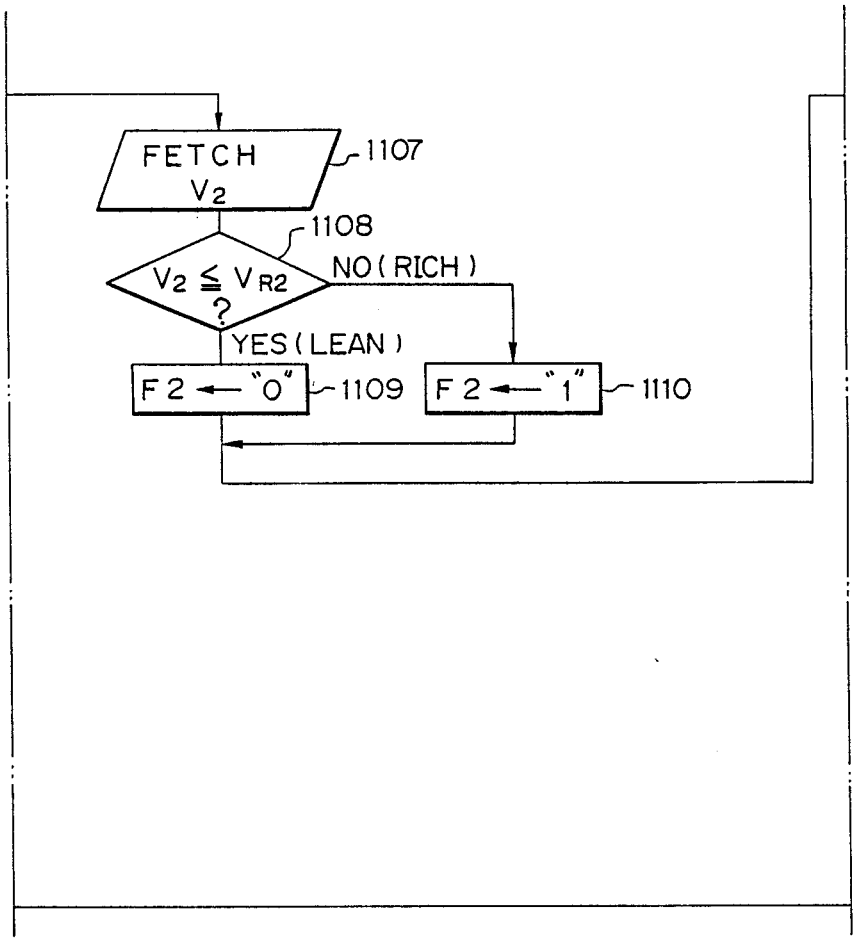
Figure 11C:
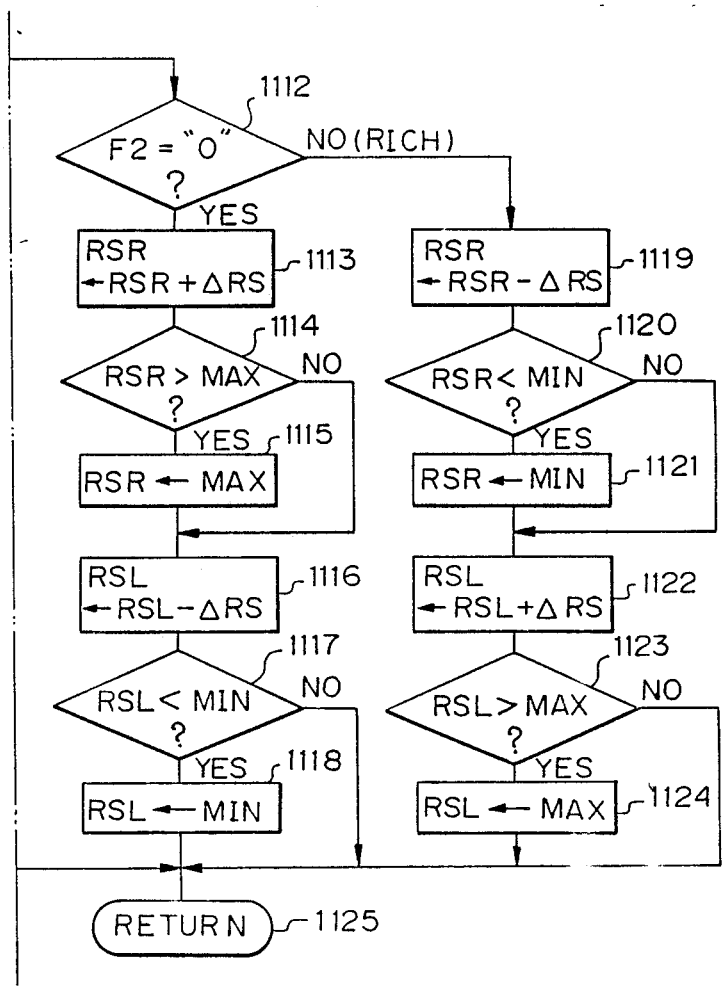

FIG. 11 is a routine for calculating the skip amounts RSR and RSL in accordance with the output of the downstream-side $O_2$ sensor 15 executed at every predetermined time period such as 1 s.

Steps 1101 through 1106 are the same as steps 801 through 806 of FIG. 8. That is, if one or more of the feedback control conditions is not satisfied, or if the execution flag XFCFBl is "0", the control proceeds directly to step 1125, thereby carrying out an open-loop control operation. Note that, in this case, the amounts RSR and RSL or the mean values $\overline{RSR}$ and $\overline{RSL}$ thereof are stored in the backup RAM 106, and in an open-loop L control operation, the values RSR and RSL or $\overline{RSR}$ and $\overline{RSL}$ are read out of the backup RAM 106.

Contrary to the above, if all of the feedback control conditions are satisfied and the execution flag XFCFBl is "1", the control proceeds to steps 1107 through 1124.

At step 1107, an A/D conversion is performed upon the output voltage $V_2$ of the downstream-side $O_2$ sensor 15, and the A/D converted value thereof is then fetched from the A/D converter 101. Then, at step 1108, the voltage $V_2$ is compared with the reference voltage $V_{R2}$ thereby determining whether the current air-fuel ratio detected by the downstream-side $O_2$ sensor 15 is on the rich side or on the lean side with respect to the stoichiometric air-fuel ratio.

At step 1108, if the air-fuel ratio downstream of the catalyst converter 12 is lean, the control proceeds to step 1109 which resets the second air-fuel ratio flag F2. Alternatively, the control proceeds to the step 1110, which sets the second air-fuel ratio flag F2, and then, at step 1111, the air-fuel ratio reversion flag FB is set.

Next, at step 1112, it is determined whether or not the second air-fuel ratio F2 is "0". If F2="0", which means that the air-fuel ratio downstream of the catalyst converter 12 is lean, the control proceeds to steps 1113 through 1118, and if F2="1", which means that the air-fuel ratio is rich, the control proceeds to steps 1119 through 1124.

At step 1113, the rich skip amount RSR is increased by ΔRS to move the air-fuel ratio to the rich side. At steps 1114 and 1115, the rich skip amount RSR is guarded by a maximum value MAX which is, for example, 7.5%.

At step 1116, the lean skip amount RSL is decreased by ΔRS to move the air-fuel ratio to the rich side. At steps 1117 and 1118, the lean skip amount RSL is guarded by a minimum value MIN which is, for example, 2.5%.

On the other hand, if F2="1" (rich), at step 1119, the rich skip amount RSR is decreased by ΔRS to move the air-fuel ratio to the lean side. At steps 1120 and 1121, the rich skip amount RSR is guarded by the minimum value MIN. Further, at step 1122, the lean skip amount RSL is decreased by the definite value ΔRS to move the air-fuel ratio to the rich side. At steps 1123 and 1124, the lean skip amount RSL is guarded by the maximum value MAX.

The skip amounts RSR and RSL are then stored in the backup RAM 106, thereby completing this routine of FIG. 11 at step 1125.

In FIG. 11, the minimum value MIN is a level by which the transient characteristics of the skip operation using the amounts RSR and RSI can be maintained, and the maximum value MAX is a level by which the drivability is not deteriorated by the fluctuation of the air-fuel ratio.

Figure 12:
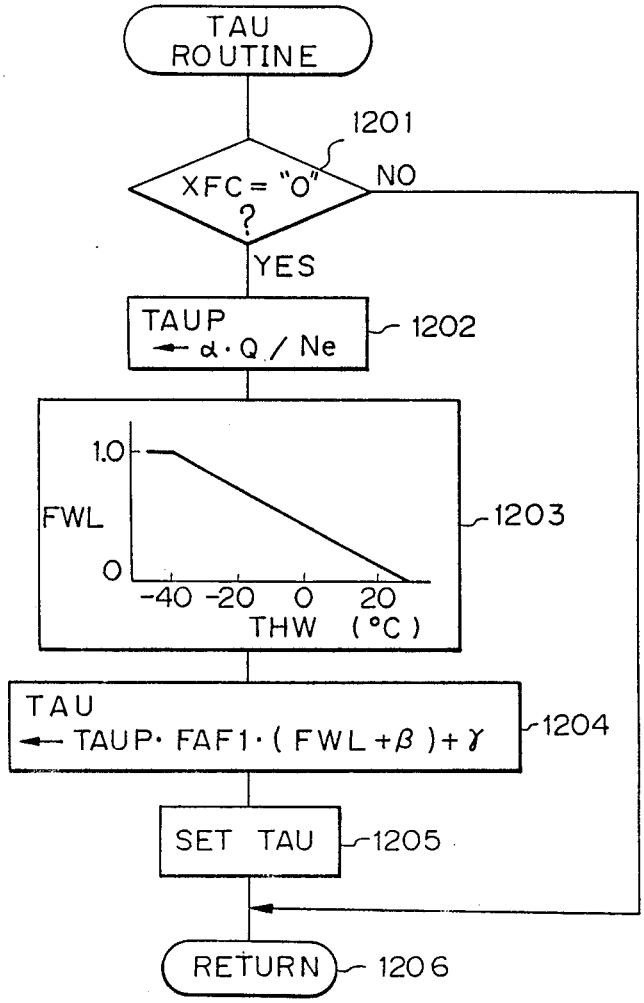

FIG. 12 is a routine for calculating a fuel injection amount TAU executed at every predetermined crank angle such as 360° CA. At step 1201, it is determined whether or not the fuel cut-off flag XFC is "1". As a result, if XFC="1", the control proceeds directly to step 1206, thereby carrying out a fuel cut-off operation. On the other hand, if XFC="0" at step 1201, the control proceeds to steps 1202 through 1205.

At step 1202, a base fuel injection amount TAUP is calculated by using the intake air amount data Q and the engine speed data Ne stored in the RAM 105. That is, $$TAUP \leftarrow \alpha \cdot Q/Ne$$

where $\alpha$ is a constant. Then at step 1203, a warming-up incremental amount FWI is calculated from a one-dimensional map by using the coolant temperature data THW stored in the RAM 105. Note that the warming-up incremental amount FWL decreased when the coolant temperature THW increases. At step 1204, a final fuel injectional amount TAU is calculated by $$TAU \leftarrow TAUP \cdot FAF1 \cdot (FWL+\beta)+\gamma$$

where $\beta$ and $\gamma$ are correction factors determined by other parameters such as the voltage of the battery and the temperature of the intake air. At step 1205, the final fuel injection amount TAU is set in the down counter 108, and in addition, the flip-flop 109 is set to initiate the activation of the fuel injection valve 7. This routine is then completed by step 1206. Note that, as explained above, when a time period corresponding to the amount TAU has passed, the flip-flop 109 is reset by the carry-out signal of the down counter 108 to stop the activation of the fuel injection valve 7.

Figure 13:
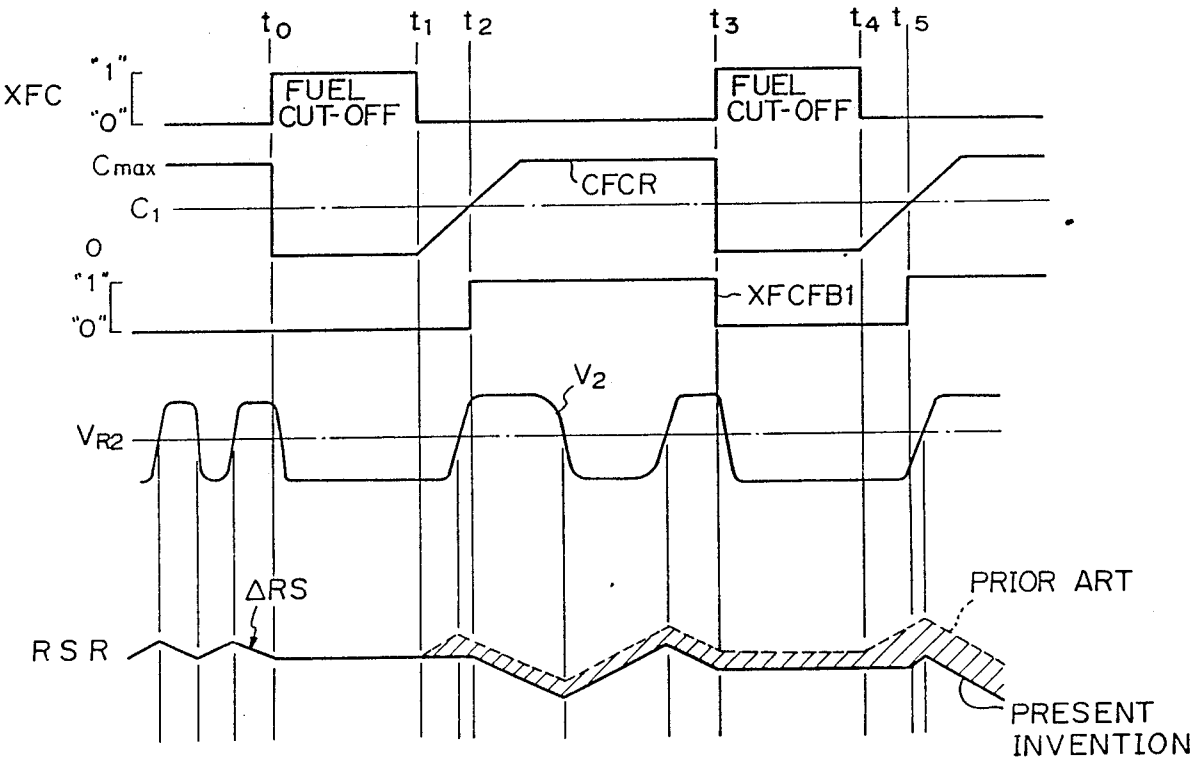

The routines of FIGS. 5, 6, 11, and 12 will be further explained with reference to FIG. 13. In FIG. 13, the fuel cut-off flag XFC, the execution flag XFCFBl, and the output $V_2$ of the downstream-side $O_2$ sensor 15 are changed in the same way in FIG. 10. That is, for a time period from $t_0$ to $t_1$ and a time period from $t_3$ to $t_4$, air-fuel ratio feedback controls for the upstream-side and downstream-side $O_2$ sensors 13 and 15 are both prohibited, i.e., an open-loop control for a lean air-fuel ratio is carried out. In this case, the rich skip amount RSR and the lean skip amount RSL (not shown) remains at a value immediately before the fuel cut-off operation.

Next, at time $t_1$ or $t_4$, when a fuel cut-off recovery state (XFC="0") is established to initiate the counting up of the duration counter value CFCR, the air-fuel ratio feedback control for the downstream-side $O_2$ sensor 15 is still prohibited before the duration counter value CFCR reaches the value $C_1$. That is, the rich skip amount RSR (the lean skip amount RSL) is unchanged. Note that, also in this case, since an air-fuel ratio feedback control for the upstream-side $O_2$ sensor 13 is carried out, the controlled air-fuel ratio is brought close to the stoichiometric air-fuel ratio.

Further, at time $t_2$ or $t_5$, when the duration counter value CFCR reaches the value $C_1$, the execution flag XFCFBl is set to thus initiate an air-fuel ratio feedback control for the output $V_2$ of the downstream-side $O_2$ sensor 15, i.e., calculating the rich skip amount RSR (the lean skip amount RSL) in accordance with the output $V_2$ of the downstream-side $O_2$ sensor 15. Therefore, also in this case, the air-fuel ratio feedback control for the output $V_1$ of the upstream-side $O_2$ sensor 13 and the air-fuel ratio feedback control for the output $V_2$ of the downstream-side $O_2$ sensor 15 are both carried out.

Thus, for a predetermined time period ($C_1 \times 4$ ms) after the fuel cut-off recovery, the renewal of the rich skip amount RSR (the lean skip amount RSL) is prohibited. Note that, if the renewal of the rich skip amount RSR (the lean skip amount RSL) is initiated immediately after the fuel cut-off recovery as in the prior art, the rich skip amount RSR (the lean skip amount RSL) is overcorrected as indicated by a dotted line, thus increasing HC and CO emissions.

Figures 14, 14A:
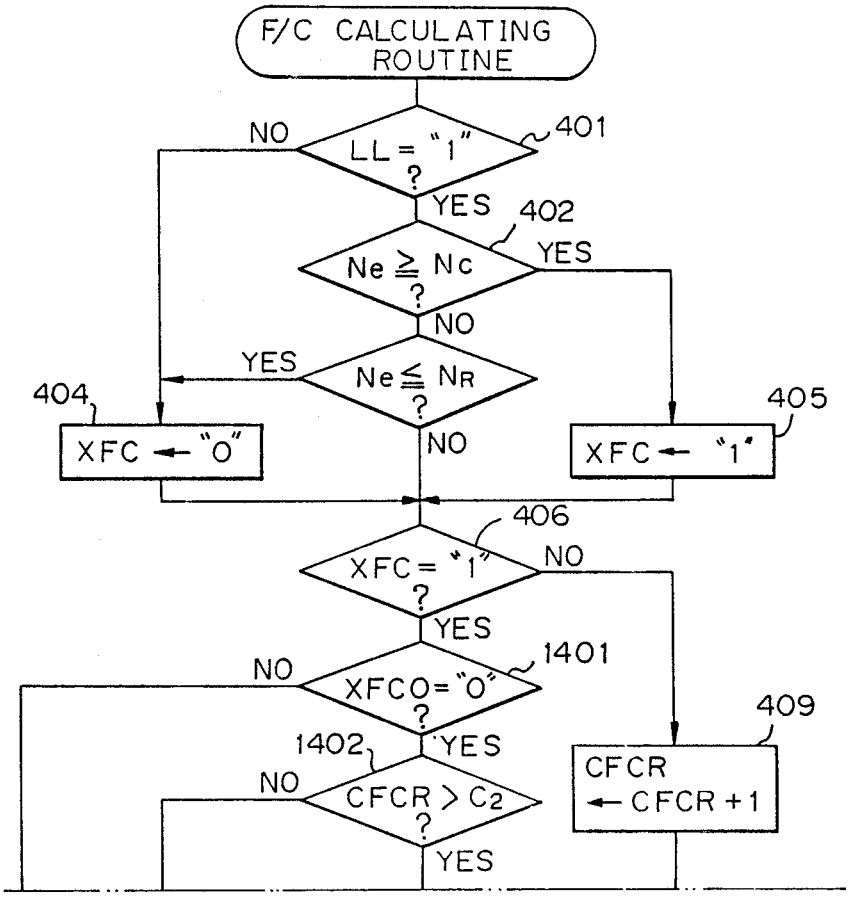
Figure 14B:
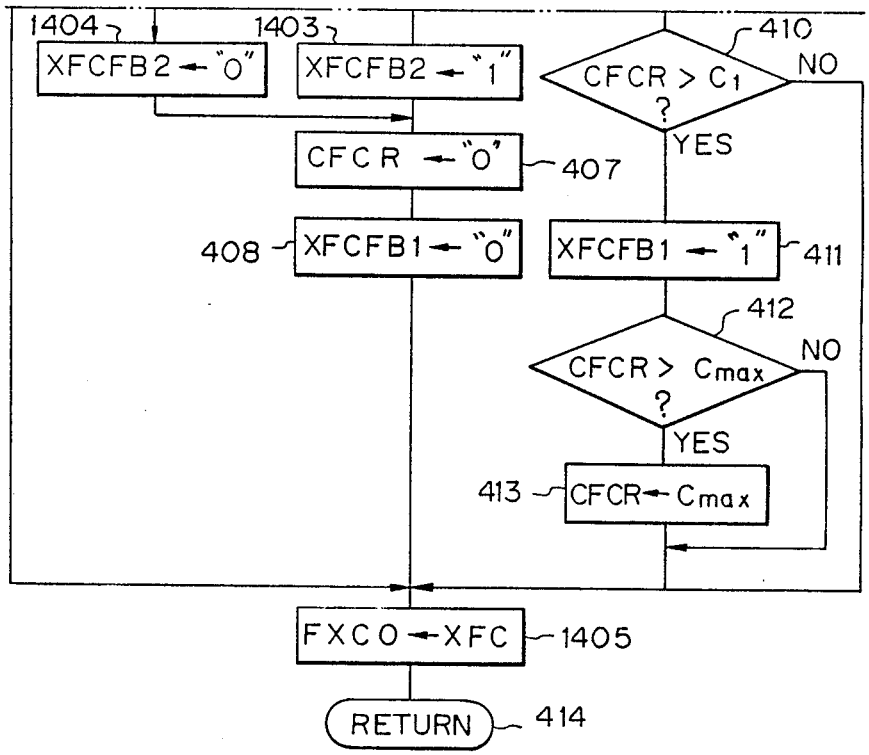

In FIG. 14, which is a modification of FIG. 4, steps 1401 through 1405 are added to FIG. 4. That is, every when the fuel cut-off flag XFC is switched from "1" to "0" to establish a fuel cut-off recovery state, the control proceeds via step 1401 to step 1402 which determines whether or not the duration counter value CFCR reaches a definite value $C_2$ which is larger than the definite value $C_1$. As a result, if $CFCR > C_2$, the control proceeds to step 1403 which sets another execution flag XFCFB2 for an air-fuel ratio feedback control for the output $V_2$ of the downstream-side $O_2$ sensor 15, while if $CFCR \leqq C_2$, the control proceeds to step 1404 which resets the execution flag XFCFB2. That is, when frequent fuel cut-off operations are carried out so that $CFCR \leqq C_2$ is satisfied before and each fuel cut-off operation, the execution flag XFCFB2 is reset, thus prohibiting an air-fuel ratio feedback control for the output $V_2$ of the downstream-side $O_2$ sensor 15. For this purpose, the routines of FIGS. 8 and 11 are modified as shown in a routine of FIG. 15 by introducing step 1501 thereto.

Figure 10:
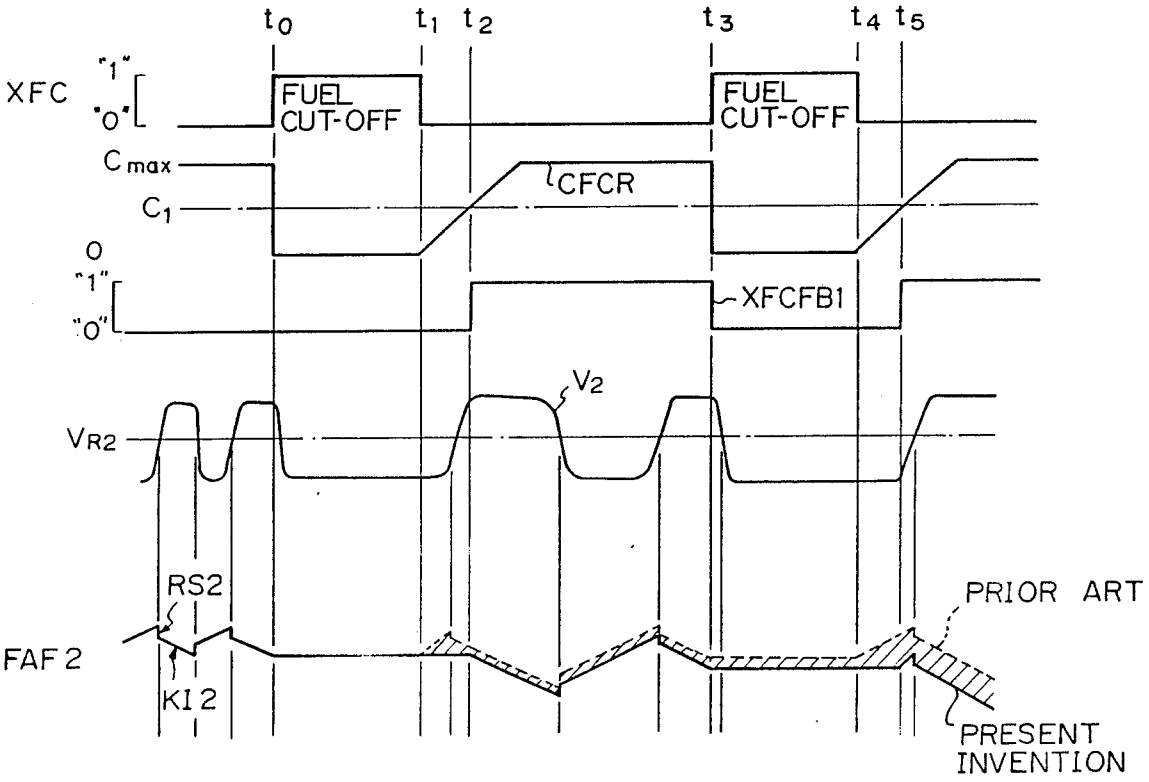
FIGS. 10, 13, 16, 17, and 20 are timing diagrams explaining the flow charts of FIGS. 5, 6, 8A–8C, 9, 11, 12, 14, 15, 18, and 19.
Figure 15:
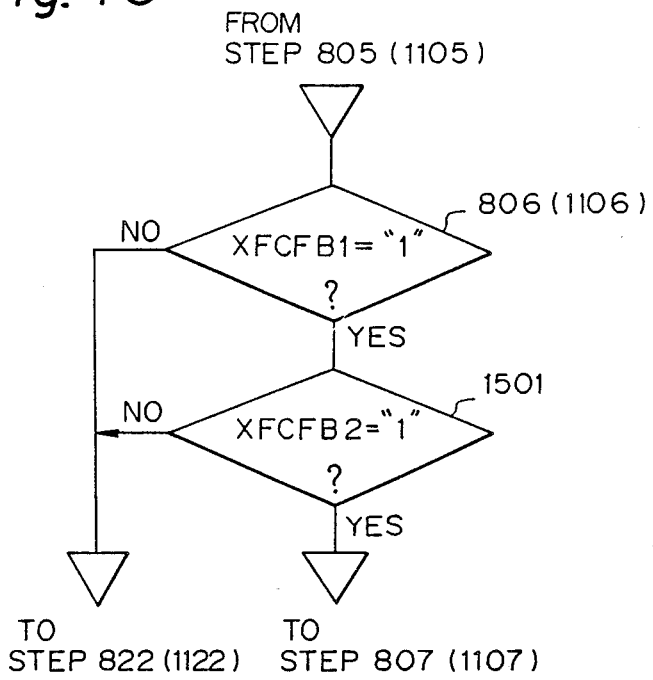
Figure 16:
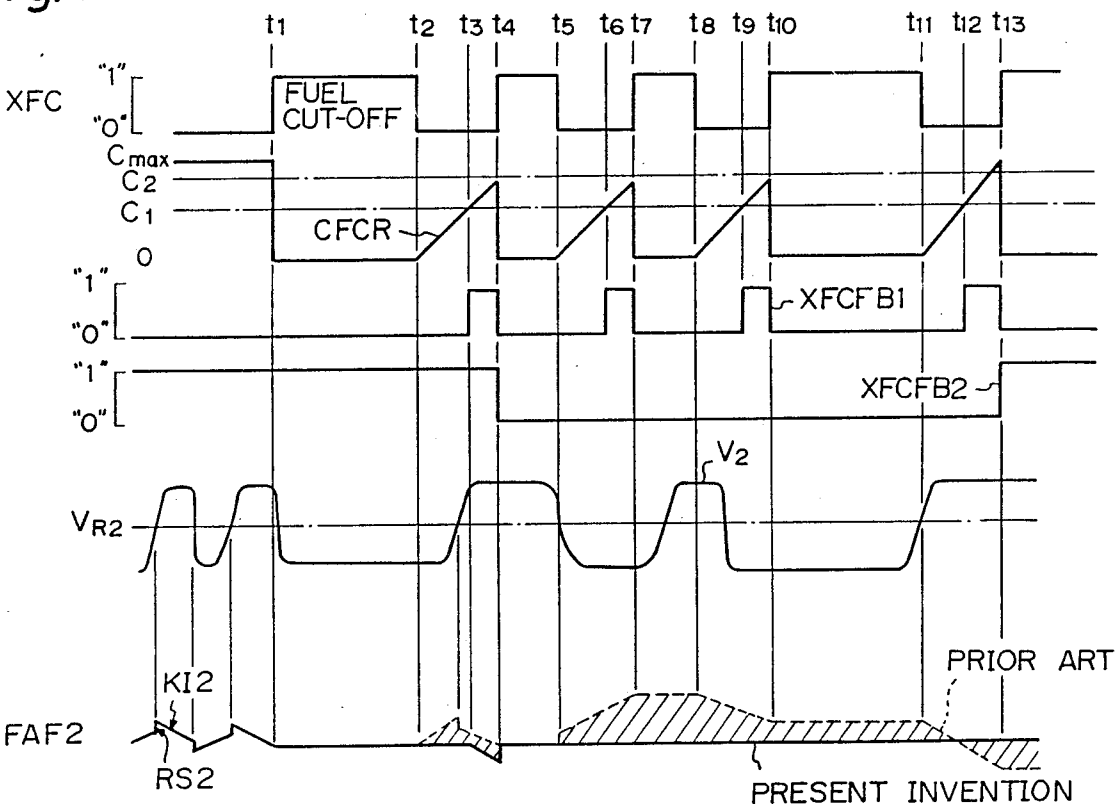

The timing diagram of FIG. 10 is modified to FIG. 16, when the routine of FIG. 14 is used instead of the routine of FIG. 4 and the routine of FIG. 8 is modified by the routine of FIG. 15. In FIG. 16, for time periods from $t_1$ to $t_2$, $t_4$ to $t_5$, $t_7$ to $t_8$, and $t_{10}$ to $t_{11}$, since a fuel cut-off operation is carried out (XFC="1"), the duration counter value CFCR remains at 0, and accordingly, the execution flag XFCB1 remains at "0". Further, air-fuel ratio feedback controls for the upstream-side and downstream-side $O_2$ sensors 13 and 15 are both prohibited, i.e., an open-loop control for a lean air-fuel ratio is carried out. In this case, the output $V_2$ of the downstream-side $O_2$ sensor 15 indicates a lean signal (low level), and the second air-fuel ratio correction amount FAF2 remains at a value immediately before the fuel cut-off operation.

Next, at time $t_2$, $t_5$, $t_8$, or $t_{11}$, a fuel cut-off recovery state (XFC="0") is established to initiate the counting up of the duration counter value CFCR, and as a result, at time $t_3$, $t_6$, $t_9$, or $t_{12}$, when the duration counter value CFCR reaches the definite value $C_1$, the first execution flag XFCB1 is set. On the other hand, the second execution flag XFCFB2 is set by whether or not the duration counter value CFCR reaches the definite value $C_2$ immediately before every fuel cut-off state reaches the definite value $C_2$. Therefore, when frequent fuel cut-off states (XFC="1") occur at time $t_4$, $t_7$, or $t_{10}$, the duration counter value CFCR cannot reach the definite value $C_2$, so that the second execution flag XFCFB2 is not set (XFCFB2="0"). Therefore, in this case, even when the first execution flag XFCB1 is set, the air-fuel ratio feedback control for the output $V_2$ of the downstream-side $O_2$ sensor 15 is still prohibited, and accordingly, the second air-fuel ratio correction amount FAF2 is unchanged. Note that, in this case, since an air-fuel ratio feedback control for the upstream-side $O_2$ sensor 13 is carried out, the controlled air-fuel ratio is brought close to the stoichiometric air-fuel ratio.

Contrary to the above, at time $t_{13}$ when the duration counter value CFCR reaches the definite value $C_2$, the second execution flag XFCFB2 is set thus initiating an air-fuel ratio feedback control for the output $V_2$ of the downstream-side $O_2$ sensor 15, i.e., calculating the second air-fuel ratio correction amount FAF2 in accordance with the output $V_2$ of the downstream-side $O_2$ sensor 15, since the first execution flag XFCB1 is already set. Therefore, in this case, the air-fuel ratio feedback control for the output $V_1$ of the upstream-side $O_2$ sensor 13 and the air-fuel ratio feedback control for the output $V_2$ of the downstream-side $O_2$ sensor 15 are both carried out.

Thus, for a predetermined time period ($C_1 \times 4$ ms) after the fuel cut-off recovery, the renewal of the second air-fuel ratio correction amount FAF2 is prohibited. In addition, when frequent fuel cut-off operations are carried out, i.e., when another fuel cut-off operation is carried out within a definite time period ($C_2 \times 4$ ms) after a fuel cut-off operation, the renewal of the second air-fuel ratio correction amount FAF2 is still prohibited. Note that, if the renewal of the second air-fuel ratio correction amount FAF2 is initiated immediately after the fuel cut-off recovery as in the prior art, the second air-fuel ratio correction amount FAF2 is overcorrected as indicated by a dotted line, thus increasing HC and CO emissions.

Figure 17:
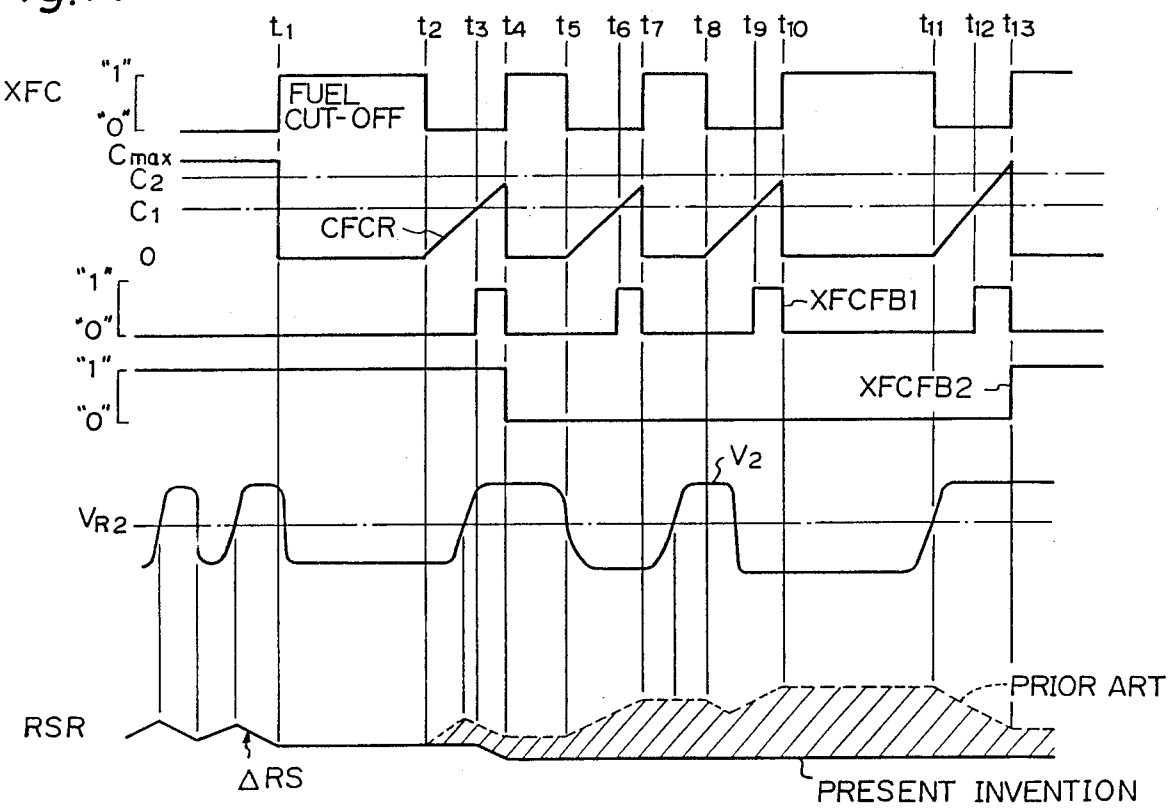

The timing diagram of FIG. 13 is modified to FIG. 17, when the routine of FIG. 14 is used instead of the routine of FIG. 4 and the routine of FIG. 11 is modified by the routine of FIG. 15. Also, in FIG. 17, for time periods from $t_1$ to $t_2$, $t_4$ to $t_5$, $t_7$ to $t_8$, and $t_{10}$ to $t_{11}$, since a fuel cut-off operation is carried out (XFC="1"), the duration counter value CFCR remains at 0, and accordingly, the execution flag XFCB1 remains at "0". Further, air-fuel ratio feedback controls for the upstream-side and downstream-side $O_2$ sensors 13 and 15 are both prohibited, i.e., an open-loop control for a lean air-fuel ratio is carried out. In this case, the output $V_2$ of the downstream-side $O_2$ sensor 15 indicates a lean signal (low level), and the rich skip amount RSR and the lean skip amount RSL (not shown) remain at values immediately before the fuel cut-off operation.

Next, at time $t_2$, $t_5$, $t_8$, or $t_{11}$, a fuel cut-off recovery state (XFC="0") is established to initiate the counting up of the duration counter value CFCR, and as a result, at time $t_3$, $t_6$, $t_9$, or $t_{12}$, when the duration counter value CFCR reaches the definite value $C_1$, the first execution flag XFCFB1 is set. On the other hand, the second execution flag XFCFB2 is set by whether or not the duration counter value CFCR reaches the definite value $C_2$ immediately before every fuel cut-off state reaches the definite value $C_2$ Therefore, when frequent fuel cut-off states (XFC="1") occur at time $t_4$, $t_7$, or $t_{10}$, the duration counter value CFCR cannot reach the definite value $C_2$, so that the second execution flag XFCFB2 is not set (XFCFB2="0"). Therefore, in this case, even when the first execution flag XFCFB1 is set, the air-fuel ratio feedback control for the output $V_2$ of the downstreamside $O_2$ sensor 15 is still prohibited, and accordingly, the rich skip amount RSR (the lean skip amount RSL) is unchanged. Note that, in this case, since an air-fuel ratio feedback control for the upstream-side $O_2$ sensor 13 is carried out, the controlled air-fuel ratio is brought close to the stoichiometric air-fuel ratio.

Contrary to the above, at time t13 when the duration counter value CFCR reaches the definite value $C_2$, the second execution flag XFCFB2 is set to thus initiate an air-fuel ratio feedback control for the output $V_2$ of the downstream-side $O_2$ sensor 15, i.e., calculating the rich skip amount RSR (the lean skip amount RSL) in accordance with the output $V_2$ of the downstream-side $O_2$ sensor 15, since the first execution flag XFCFB1 is already set. Therefore, in this case, the air-fuel ratio feedback control for the output $V_1$ of the upstream-side $O_2$ sensor 13 and the air-fuel ratio feedback control for the output $V_2$ of the downstream-side $O_2$ sensor 15 are both carried out.

Thus, for a predetermined time period ($C_1 \times 4$ ms) after the fuel cut-off recovery, the renewal of the rich skip amount RSR (the lean skip amount RSL) is prohibited. In addition, when frequent fuel cut-off operations are carried out, i.e., when another fuel cut-off operation is carried out within a definite time period ($C_2 \times 4$ ms) after a fuel cut-off operation, the renewal of the rich skip amount RSR (the lean skip amount RSL) is still prohibited. Note that, if the renewal of the rich skip amount RSR (the lean skip amount RSL) is initiated immediately after the fuel cut-off recovery as in the prior art, the rich skip amount RSR (the lean skip amount RSL is overcorrected as indicated by a dotted line, thus increasing HC and CO emissions.

Figure 3:
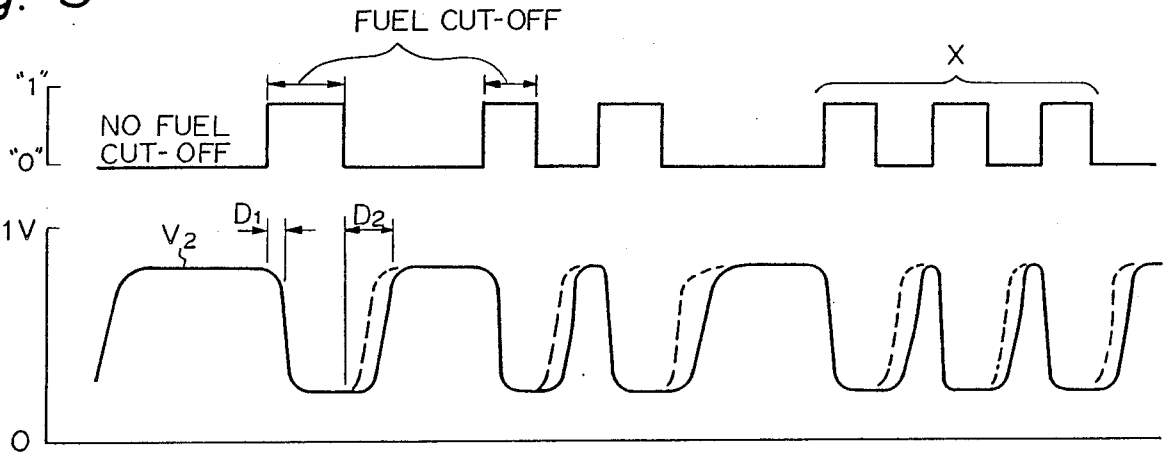
FIG. 3 is timing diagram showing an example of overcorrection of an air-fuel ratio feedback parameter in the prior art.
Figure 19:
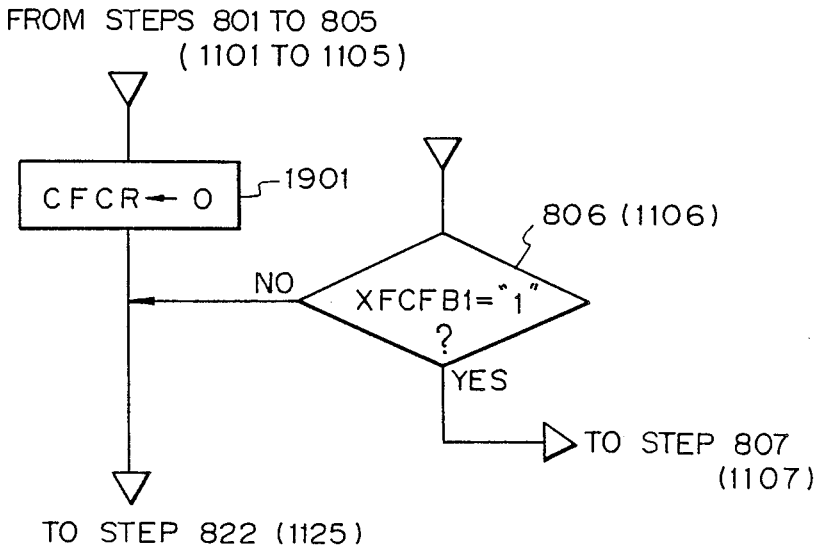
Figure 20:
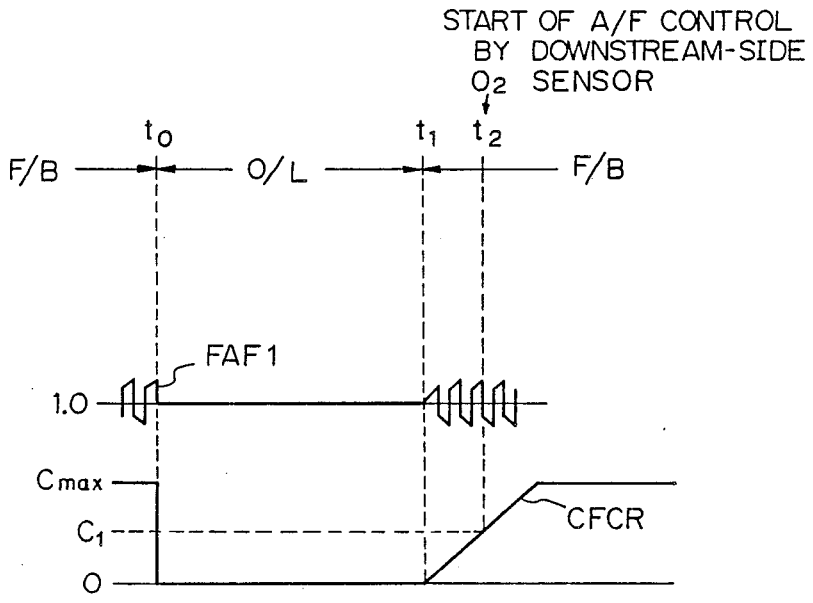

In the above-mentioned embodiment, the definite value $C_1$ is definite, but preferably that this value $C_1$ is variable in dependency upon the amount of the exhaust gas, in view of the delay $D_2$ in FIG. 3 due to the transport delay of the exhaust gas and the $O_2$ storage effect. Since the amount of the exhaust gas is dependent upon the number of reversions of the upstream-side $O_2$ sensor 15, the routine of FIG. 6 is modified by a routine of FIG. 18. That is, at step 1801 of FIG. 18, the counter value CFCR is counted up by +1, and accordingly, in this case, the counter value CFCR represents the number of reversions of the output $V_1$ of the upstream-side $O_2$ sensor 13, i.e., the number of skip operations of the first air-fuel ratio correction amount FAF1. The duration counter value CFCR is reset when at least one of the air-fuel ratio feedback control conditions for the downstream-side $O_2$ sensor 15 is not satisfied. That is, the duration counter value CFCR is reset by a routine of FIG. 19 which is a modification of FIGS. 8 or 15. Therefore, in this case, the duration counter value CFCR is changed as shown in FIG. 20.

Figure 18:
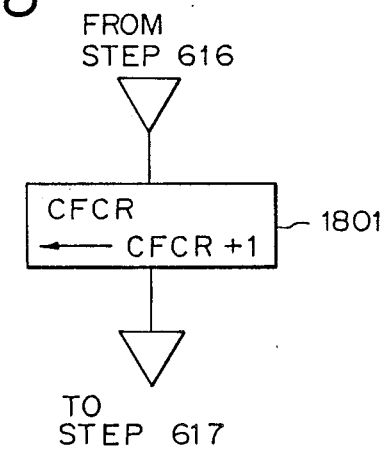

Note that, if the routine of FIG. 6 is modified by the routine of FIG. 18, step 409 of FIGS. 4 and 14 is deleted.

The present invention is also applied to a single $O_2$ sensor system where only one $O_2$ sensor 15 is provided downstream of the catalyst converter 12. In this case, the routines of FIGS. 6, 11, and 12 are not used, while the routines of FIGS. 4, 8, 9, 14, and 15 are used. Also, at step 904 of FIG. 9, the time period TAU is calculated by $$TAU \leftarrow TAUP \cdot FAF2 \cdot (FWL + \beta) + \gamma.$$

That is, for a period defined by $CFCR = C_1$ after every fuel cut-off recovery state, the air-fuel ratio is controlled by an open loop control by using the value FAF2 or $\overline{FAF2}$ corresponding to the stoichiometric ratio stored in the backup RAM 106, so that the controlled air-fuel ratio is brought close to the stoichiometric ratio. Thereafter, the air-fuel ratio is brought close to the stoichiometric ratio by an air-fuel ratio feedback control for the downstream-side $O_2$ sensor 15. Also, when frequent fuel cut-off operations are carried out, the air-fuel ratio feedback control for the output $V_2$ of the downstream-side $O_2$ sensor 15 can be also prohibited by modifying the routine of FIG. 8 with the routine of FIG. 15.

Also, other lean open loop controlling parameters can be used instead of the fuel cut-off state parameter XFC.

Note that the first air-fuel ratio feedback control by the upstream-side $O_2$ sensor 13 is carried out at every relatively small time period, such as 4 ms, and the second air-fuel ratio feedback control by the downstream-side $O_2$ sensor 15 is carried out at every relatively large time period, such as 1 s. That is because the upstream-side $O_2$ sensor 13 has good response characteristics when compared with the downstream-side $O_2$ sensor 15.

Further, the present invention can be applied to a double $O_2$ sensor system in which other air-fuel ratio feedback control parameters, such as the integration amounts KIR and KIL, the delay time periods TDR and TDL, or the reference voltage $V_{R1}$, are variable.

Still further, a Karman vortex sensor, a heat-wire type flow sensor, and the like can be used instead of the airflow meter.

Although in the above-mentioned embodiments, a fuel injection amount is calculated on the basis of the intake air amount and the engine speed, it can be also calculated on the basis of the intake air pressure and the engine speed, or the throttle opening and the engine speed.

Further, the present invention can be also applied to a carburetor type internal combustion engine in which the air-fuel ratio is controlled by an electric air control value (EACV) for adjusting the intake air amount; by an electric bleed air control valve for adjusting the air bleed amount supplied to a main passage and a slow passage; or by adjusting the secondary air amount introduced into the exhaust system. In this case, the base fuel injection amount corresponding to TAUP at step 902 of FIG. 9 or at step 1202 or FIG. 12 is determined by the carburetor itself, i.e., the intake air negative pressure and the engine speed, and the air amount corresponding to TAU at step 904 of FIG. 9 or at step 1204 of FIG. 12.

Further, a CO sensor, a lean-mixture sensor or the like can be also used instead of the $O_2$ sensor.

As explained above, according to the present invention, when the control is transferred from an open-loop control mode for the downstream-side air-fuel ratio sensor to an air-fuel ratio feedback control mode for the downstream-side air-fuel ratio sensor, a renewal of the second air-fuel ratio correction amount or the air-fuel ratio feedback control parameter in accordance with the downstream-side air-fuel ratio sensor is prohibited for a period, thereby avoiding overcorrection of the air-fuel ratio correction amount, and thus improving the emission and fuel consumption characteristics.

We claim:

1. A method for controlling an air-fuel ratio in an internal combustion engine having a catalyst converter for removing pollutants in the exhaust gas thereof, and upstream-side and downstream-side air-fuel ration sensors disposed upstream and downstream, respectively, of said catalyst converter, for detecting a concentration of a specific component in the exhaust gas, comprising the steps of:

sensing air-fuel ration feedback control conditions for said downstream-side air-fuel ration sensor;

determining whether or not all the air-fuel ratio feedback control conditions for said downstream-side air-fuel ratio sensor are satisfied;

controlling the air-fuel ration of said engine by an open loop control so that it is brought close to an air-fuel ratio, when at least one of the air-fuel ratio feedback control conditions for said downstream-side air-fuel ratio sensor is not satisfied;

controlling the air-fuel ratio of said engine in accordance with the output of said upstream-side air-fuel ratio sensor so that it is brought close to the stoichiometric air-fuel ratio while prohibiting control of said air-fuel ratio of said engine in accordance with the output of said downstream-side air-fuel ratio sensor for a period after all the air-fuel ratio feedback control condition for said downstream-side air-fuel ratio sensor are satisfied; and controlling the air-fuel ratio of said engine in accordance with the outputs of said upstream-side and downstream-side air-fuel ratio sensors so that it is brought close to the stoichiometric air-fuel ratio after said period has passed.

2. A method as set forth in claim 1, further comprising the steps of:

calculating a time period from a time when all the air-fuel ratio feedback control conditions for said downstream-side air-fuel ratio sensor are satisfied to a time when at least one of the air-fuel ratio feedback control conditions for said downstream-side air-fuel ratio sensor is not satisfied;

determining whether or not said time period is smaller than a definite period;

prohibiting the control of the air-fuel ratio of said engine in accordance with the output of said downstream-side air-fuel ratio sensor when said time period is smaller than said definite period.

3. A method as set forth in claim 1, wherein the air-fuel ratio feedback control conditions for said downstream-side air-fuel ratio sensor include all the air fuel ratio feedback control conditions for said upstream-side air-fuel ratio sensor, which include a condition of a fuel cut-off state of said engine.

4. A method as set forth in claim 1, wherein the air-fuel ratio feedback control conditions for said downstream-side air-fuel ratio sensor include a condition of a coolant temperature of said engine.

5. A method as set forth in claim 1, wherein the air-fuel ratio feedback control conditions for said downstream-side air-fuel ratio sensor include a condition of an idling state of said engine.

6. A method as set forth in claim 1, wherein the air-fuel ratio feedback control conditions for said downstream-side air-fuel ratio sensor include a condition of an activation state of said downstreamside air-fuel ratio sensor.

7. A method as set forth in claim 1, wherein the air-fuel ratio feedback control conditions for said downstream-side air-fuel ratio sensor include a condition of a load of said engine.

8. A method as set forth in claim 1, wherein said period is a definite time period.

9. A method as set forth in claim 1, wherein said period is defined by a definite number of reversions of the output of said upstream-side air-fuel ratio sensor which is switched from the rich side to the lean side and vice versa.

10. A method as set forth in claim 1, wherein said air-fuel ratio controlling step in accordance with the output of said upstream-side air-fuel ratio sensor comprises the steps of:

calculating a first air-fuel ratio correction amount in accordance with the output of said upstream-side air-fuel ratio sensor; and adjusting an actual air-fuel ratio in accordance with said first air-fuel ratio correction amount, and wherein said air-fuel ratio controlling step in accordance with the output of said upstream-side and downstream-side air-fuel ratio sensors comprises the steps of:

calculating said first air-fuel ratio correction amount in accordance with the output of said upstream-side air-fuel ratio sensor;

calculating a second air-fuel ratio correction amount in accordance with the output of said downstream-side air-fuel ratio sensor; and adjusting said actual air-fuel ratio in accordance with said first and second air-fuel ratio correction amounts.

11. A method as set forth in claim 1, wherein said air-fuel ratio controlling step in accordance with the output of said upstream-side air-fuel ratio sensor comprises the steps of:

calculating an air-fuel ratio correction amount in accordance with the output of said upstream-side air-fuel ratio sensor; and adjusting an actual air-fuel ratio in accordance with said air-fuel ratio correction amount;

wherein said air-fuel ratio controlling step in accordance with the output of said upstream-side and downstream-side air-fuel ratio sensors comprises the steps of:

calculating said air-fuel ratio correction amount in accordance with the output of said upstream-side air-fuel ratio sensor;

calculating an air-fuel ratio feedback control parameter in accordance with the output of said downstream-side air-fuel ratio sensor; and adjusting said actual air-fuel ratio in accordance with the output of said upstream-side air-fuel ratio sensor and said air-fuel ratio feedback control parameter.

12. A method as set forth in claim 11, wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side.

13. A method as set forth in claim 11, wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side.

14. A method as set forth in claim 11, wherein said air-fuel ratio feedback control parameter is determined by a rich delay time period for delaying the output of said upstream-side air-fuel ration sensor switched from the lean side to the rich side and a lean delay time period for delaying the output of said upstream-side air-fuel ratio sensor switched from the rich side to the lean side.

15. A method as set forth in claim 11, wherein said air-fuel ratio feedback control parameter is determined by a reference voltage with which the output of said upstream-side air-fuel ratio sensor is compared, thereby determining whether the air-fuel ratio is on the rich side or on the lean side.

16. An apparatus for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising:

means for sensing air-fuel ratio feedback control conditions for said downstream-side air-fuel ratio sensor;

means for determining whether or not all the air-fuel ratio feedback control conditions for said downstream-side air-fuel ratio sensor are satisfied;

means for controlling the air-fuel ratio of said engine by an open loop control so that it is brought close to an air-fuel ratio, when at least one of the air-fuel ratio feedback control conditions for said downstream-side air-fuel ratio sensor is not satisfied;

means for controlling the air-fuel ratio of said engine in accordance with the output of said upstream-side air-fuel ratio sensor so that it is brought close to the stoichiometric air-fuel ratio while prohibiting control of said air-fuel ratio of said engine in accordance with the output of said downstream-side air-fuel ratio sensor for a period after all the air-fuel ratio feedback control conditions for said downstream-side air-fuel ratio sensor are satisfied; and means for controlling the air-fuel ratio of said engine in accordance with the outputs of said upstream-side and downstream-side air-fuel ratio sensors so that it is brought close to the stoichiometric air-fuel ratio after said period has passed.

17. An apparatus as set forth in claim 16, further comprising:

means for calculating a time period from a time when all the air-fuel ratio feedback control conditions for said downstream-side air-fuel ratio sensor are satisfied to a time when at least one of the air-fuel ratio feedback control conditions for said downstream-side air-fuel ratio sensor is not satisfied;

means for determining whether or not said time period is smaller than a definite period; and means for prohibiting the control of the air-fuel ratio of said engine is accordance with the output of said downstream-side air-fuel ratio sensor when said time period is smaller than said definite period.

18. An apparatus as set forth in claim 16, wherein the air-fuel ratio feedback control conditions for said downstream-side air-fuel ratio sensor include all the air-fuel ratio feedback control conditions for said upstream-side air-fuel ratio sensor, which include a condition of a fuel cut-off state of said engine.

19. An apparatus as set forth in claim 16, wherein the air-fuel ratio feedback control conditions for said downstream-side air-fuel ratio sensor include a condition of a coolant temperature of said engine.

20. An apparatus as set forth in claim 16, wherein the air-fuel ratio feedback control conditions for said downstream-side air-fuel ratio sensor include a condition of an idling state of said engine.

21. An apparatus as set forth in claim 16, wherein the air-fuel ratio feedback control conditions for said downstream-side air-fuel ratio sensor include a condition of an activation state of said downstream-side air-fuel ratio sensor.

22. An apparatus as set forth in claim 16, wherein the air-fuel ratio feedback control conditions for said downstream-side air-fuel ratio sensor include a condition of a load of said engine.

23. An apparatus as set forth in claim 16, wherein said period is a definite time period.

24. An apparatus as set forth in claim 16, wherein said period is defined by a definite number of reversions of the output of said upstream-side air-fuel ratio sensor which is switched from the rich side to the lean side and vice versa.

25. An apparatus as set forth in claim 16, wherein said air-fuel ratio controlling means in accordance with the output of said upstream-side air-fuel ratio sensor comprises:

means for calculating a first air-fuel ratio correction amount in accordance with the output of said upstream-side air-fuel ratio sensor; and means for adjusting an actual air-fuel ratio in accordance with said first air-fuel ratio correction amount, and wherein said air-fuel ratio controlling means in accordance with the output of said upstream-side and downstream-side air-fuel ratio sensors comprises:

means for calculating said first air-fuel ratio correction amount in accordance with the output of said upstream-side air-fuel ratio sensor;

means for calculating a second air-fuel ratio correction amount in accordance with the output of said downstream-side air-fuel ratio sensor; and means for adjusting said actual air-fuel ratio in accordance with said first and second air-fuel ratio correction amounts.

26. An apparatus as set forth in claim 16, wherein said air-fuel ratio controlling means in accordance with the output of said upstream-side air-fuel ratio sensor comprises:

means for calculating an air-fuel ratio correction amount in accordance with the output of said upstream-side air-fuel ratio sensor; and means for adjusting an actual air-fuel ratio in accordance with said air-fuel ratio correction amount, and wherein said air-fuel ratio controlling means in accordance with the output of said upstream-side and downstream-side air-fuel ratio sensors comprises:

means for calculating said air-fuel ratio correction amount in accordance with the output of said upstream-side air-fuel ratio sensor;

means for calculating an air-fuel ratio feedback control parameter in accordance with the output of said downstream-side air-fuel ratio sensor; and means for adjusting said actual air-fuel ratio in accordance with the output of said upstream-side air-fuel ratio sensor and said air-fuel ratio feedback control parameter.

27. An apparatus as set forth in claim 26, wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side.

28. An apparatus as set forth in claim 26, wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side.

29. An apparatus as set forth in claim 26, wherein said air-fuel ratio feedback control parameter is determined by a rich delay time period for delaying the output of said upstream-side air-fuel ratio sensor switched from the lean side to the rich side and a lean delay time period for delaying the output of said upstream-side air-fuel ratio sensor switched from the rich side to the lean side.

30. An apparatus as set forth in claim 26, wherein said air-fuel ratio feedback control parameter is determined by a reference voltage with which the output of said upstream-side air-fuel ratio sensor is compared, thereby determining whether the air-fuel ratio is on the rich side or on the lean side.

* * * * *